US006166338A

United States Patent [19]

Ebato

[11] Patent Number: 6,166,338

[45] Date of Patent: Dec. 26, 2000

[54] TUBULAR SWITCH AND DEVICE FOR CONNECTING THE SWITCH

[75] Inventor: Hiroshi Ebato, Tokorozawa, Japan

[73] Assignee: Ebac Corporation, Saitama-ken, Japan

[21] Appl. No.: 09/214,706

[22] PCT Filed: Jul. 8, 1997

[86] PCT No.: PCT/JP97/02356

§ 371 Date: Jan. 11, 1999

§ 102(e) Date: Jan. 11, 1999

[87] PCT Pub. No.: WO98/01875

PCT Pub. Date: Jan. 15, 1998

[30] Foreign Application Priority Data

| | | | |
|---|---|---|---|
| Jul. 9, 1996 | [JP] | Japan | 8-179018 |
| Dec. 19, 1996 | [JP] | Japan | 8-339886 |
| Mar. 14, 1997 | [JP] | Japan | 9-060788 |
| Jul. 7, 1997 | [JP] | Japan | 9-180888 |

[51] Int. Cl.[7] ..... H01H 3/16

[52] U.S. Cl. ..... 200/61.43; 200/61.73

[58] Field of Search ..... 49/26–28; 200/61.41–61.44, 200/61.62, 61.71, 61.73, 85 R, 86 R, 86 A, 511, 512, 514

[56] References Cited

U.S. PATENT DOCUMENTS

| | | | |
|---|---|---|---|
| 3,778,805 | 12/1973 | Gould | 340/272 |
| 4,317,970 | 3/1982 | Hafner et al. | 200/61.43 |
| 4,617,433 | 10/1986 | Hoshikawa et al. | 200/86 R |
| 4,876,420 | 10/1989 | Lodini | 200/86 R |
| 5,118,910 | 6/1992 | Duhon et al. | 200/86 R |
| 5,192,837 | 3/1993 | Chardon | 200/61.41 |
| 5,880,421 | 3/1999 | Tsuge et al. | 200/61.44 |

*Primary Examiner*—Michael Friedhofer
*Attorney, Agent, or Firm*—Venable; Robert J. Frank; Ashley J. Wells

[57] ABSTRACT

A tubular switch which is normally off, instantaneously turned on by external pressure, and has long detection distance. The tubular switch comprises a tubular hose member having insulating property and elasticity, and a plurality of flexible conductive members which are spirally fixed to the internal surface of the hose member so that the surfaces of the conductive members should be partially exposed to the internal space of the hose member at any section of the hose member. The tubular switch has durability, can be installed any place, and can have a long detection range, and, in addition, any faults are easily found, repaired and adjusted, it has a simple structure and flexibility, and it can be manufactured at a low cost.

19 Claims, 26 Drawing Sheets

(B)

(A)

(A)

(B)

(A)

(B)

(A)

(B)

TUBULAR SWITCH AND DEVICE FOR CONNECTING THE SWITCH

BACKGROUND OF THE INVENTION

1. Field of the Invention

The present invention relates to a tubular switch which is normally off, instantaneously turned on by external pressure, and has a long detection distance, and a connecting device therefor.

2. Description of the Related Art

FIG. 29 presents drawings representing an example of conventional long length switches (tape switch).

This switch is constituted by two pieces of belt-shaped conductors 1 and 2 composed of a spring material which has been subjected to hardening and thickly plated with copper, insulation film 3 holding both sides of the belt-shaped conductors 1 and 2 in their longitudinal direction so that the conductors should be substantially parallel, and a covering member 4 covering the aforementioned components and composed of a highly corrosion-resistant resin.

However, the aforementioned conventional tape switch has a belt-like shape as a whole and operates in response to a load in the thickness direction. Therefore, it has a problem that its detection direction is limited.

In addition, it may be damaged when twisted, and it cannot be used at a location having irregularity, or a curved place.

Moreover, because of its belt-like shape, it should be wound up on its surface and it lacks flexibility. Therefore, its handling is troublesome in use where its installation and storage should be repeated.

Furthermore, because the belt-shaped conductors should be kept in parallel, its structure is complicated, and it becomes expensive. In addition, a long length one cannot practically be used.

Further, when permanent contact of the belt-shaped conductors is caused due to their permanent deformation, or the conductors are broken, the break down points cannot easily be found, and it is difficult to repair and reuse it even when it is damaged partially.

Moreover, actuation force is defined by the structure, and it is difficult to alter the actuation force afterward.

The object of the present invention is to provide a tubular switch wherein it has durability, it can be installed any place, and can have long detection range, and, in addition, its faults are easily found, repaired and adjusted, it has a simple structure and flexibility, and it can be manufactured at a low cost, and to provide a connector device therefor.

SUMMARY OF THE INVENTION

In order to achieve the aforementioned object, there are provided:

a first embodiment of the present invention which is a tubular switch comprising a tubular hose member having insulating property and elasticity, and a plurality of flexible conductive members which are spirally fixed to the internal surface of the hose member so that the surfaces of the conductive members should be partially exposed to the internal space of the hose member at any section of the hose member;

a second embodiment of the present invention wherein the hose member is transparent or translucent;

a third embodiment of the present invention wherein the conductive members are composed of a plurality of twisted or woven fine metal strands;

a fourth embodiment of the present invention wherein the conductive members comprise a conductive layer having flexibility and/or elasticity and a bare electric wire member disposed so that it should be in contact with the conductive layer;

a fifth embodiment of the present invention wherein the conductive layer is composed of a conductive rubber or conductive resin;

a sixth embodiment of the present invention wherein the conductive members are composed of a conductive layer having flexibility and elasticity and an insulation layer having flexibility and elasticity which are alternately wound in a spiral and a bare electric wire member wound on the external surface of the conductive layer, and the hose member is composed of an insulating material and covers the conductive layer, the insulation layer, and the bare electric wire member;

seventh embodiment of the present invention wherein the conductive member is composed of a conductive layer having flexibility and elasticity spirally wound with a gap and a bare electric wire member wound on the external surface of the conductive layer, and the hose member is composed of an insulating material and covers the conductive layer and the bare electric wire member;

an eighth embodiment of the present invention wherein the conductive member comprises a bare electric wire member and a joint member for jointing the bare electric wire member to the hose member, which is composed of a material having flexibility and elasticity and capable of being adhered to the hose member;

ninth embodiment of the present invention wherein the bare electric wire member is a tubular mesh member composed of metal wires woven in a tubular shape, and the joint member is inserted into the tubular mesh member;

tenth embodiment of the present invention wherein the bare electric wire member is a metal wire including monofilaments, twisted wires and flat mesh wires, and the joint member is composed of a conductive rubber or conductive resin and twisted with the metal wire;

eleventh embodiment of the present invention wherein the conductive member comprises a bare electric wire member and a joint member composed of a conductive rubber or conductive resin which has flexibility and elasticity and is a material similar to that of the hose member and capable of being adhered to the hose member, the joint member covering the bare electric wire member and jointing the wire to the hose member;

a twelfth embodiment of the present invention wherein the joint member has elasticity, and is a transparent or translucent tubular or cord-shape member;

a thirteenth embodiment of the present invention which is a tubular switch comprising a tubular hose member having insulating property and elasticity, a plurality of flexible first conductive members which are disposed on the internal surface of the hose member along the longitudinal direction of the hose member, first joint members having conductivity and elasticity and jointing the first conductive members to the hose member, a flexible second conductive member which is disposed in the hose member along the longitudinal direction of the hose member around the center of the radial section of the hose member, and second joint members having conductivity and elasticity which are disposed so that they should not be in contact with the first joint members and support the second conductive member on the hose member with supporting portions having a radially extended section in the radial section of the hose member;

a fourteenth embodiment of the present invention wherein the hose member has a band-like groove on its external surface along the longitudinal direction of the hose member;

a fifteenth embodiment of the present invention wherein a luminescent member or light-reflecting member is provided in the hose member or the joint members or provided on the internal or external surfaces of those members;

a sixteenth of the present invention wherein a reinforcing member composed of woven metal wires or synthetic fibers is further provided on the external surface of the hose member;

a seventeenth embodiment of the present invention which is a connecting device for connecting an end of a tubular switch of the preceding embodiments to an end of another similar tubular switch or an external electric wire or for sealing an end of the tubular switch, which comprises a core member to be inserted into the inside of the hose member so that it should closely contact with the hose member, contact point members provided on a part of the external surface of the core member and to be contacted with the conductive members, and a covering member to be fitted to the external surface of the hose member; and an eighteenth embodiment of the present invention in which, the connecting device for tubular switches of seventeenth embodiment comprises a first connecting device to be connected to one tubular switch, and a second connecting device to be connected to the other tubular switch or an external electric wire, or to seal an end of the one tubular switch, wherein the covering member of the first connecting device and the covering member of the second connecting device are fitted and fixed to each other.

DESCRIPTION OF THE PREFERRED EMBODIMENTS

Embodiments of the present invention will be further explained more in detail hereinafter with reference to the drawings and the like.

(First Embodiment of Tubular Switch)

Figure 1:
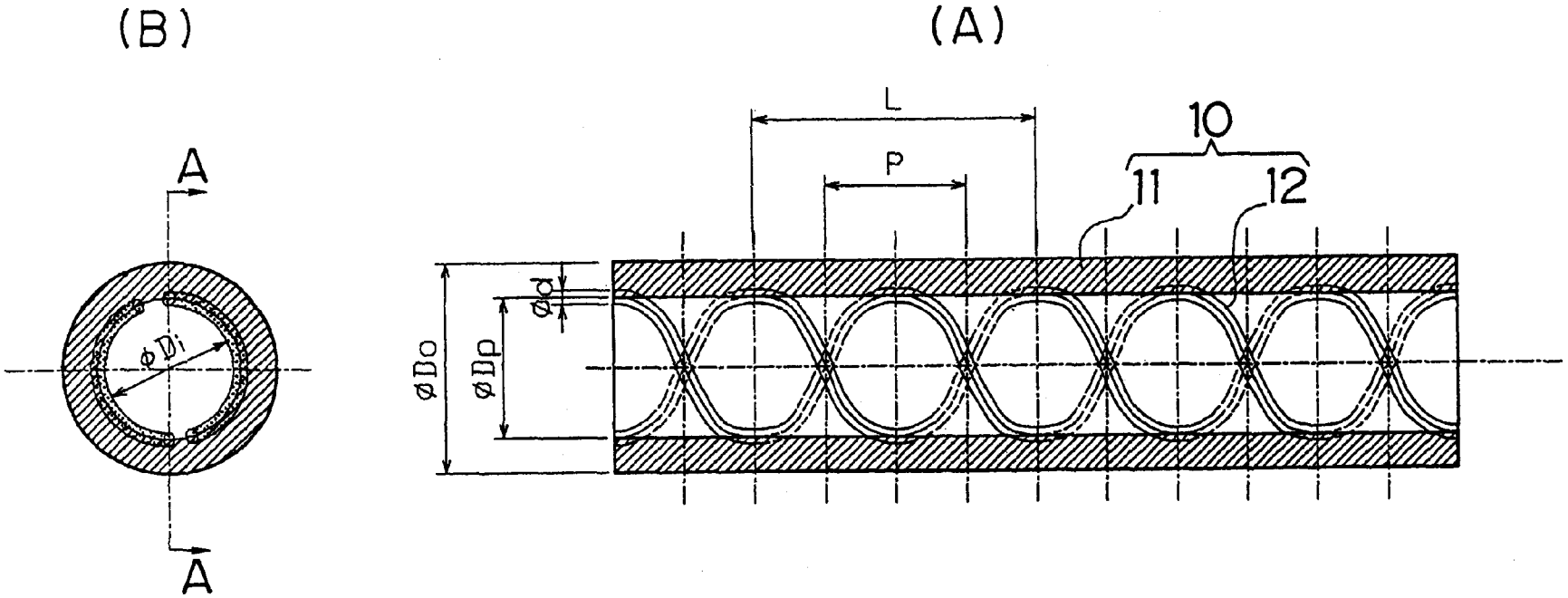
FIGS. 1(*a*) and (*b*) presents sectional views representing the first embodiment of the tubular switch of the present invention.

FIG. 1 presents sectional views representing the first embodiment of the tubular switch of the present invention.

This tubular switch 10 consists of a hose member 11 and conductive members 12.

The hose member 11 is a member of tubular shape composed of a rubber or resin having elasticity and insulating property. The conductive members 12 are spiral members having conductivity and flexibility, composed of a plurality of lines, and fixed on the internal surface of the hose member 11 so that their surface are partially exposed to internal space of the hose member 11 at any section of the hose member 11.

As for this tubular switch 10, when the hose member 11 is deformed by pressing it even at any location (with a pressing width larger than the length P along the longitudinal direction of the hose member 11), and the conductive members 12 exposed to the internal surface of the hose member 11 are always crossed and contacted with each other because they are in a plural number and wound spirally. Therefore, when one of the conductive member is connected to a power source, electric current flows to the other conductive member 12, and thus switch function is obtained.

Because the hose member 11 has insulating property, electric current does not flow to the pressing object, and electrical leakage to the outside does not occur.

The conductive member 12 is preferably composed of a material having flexibility such as copper wires deposited with tin and steel wires deposited with copper so as to contribute to automatic restoring function, which will be explained hereinafter.

The hose member 11 preferably has airtight property, and if it has airtight property, a circular section of the hose member 11 can be maintained by giving internal pressure with compressed air or the like. The hose member 11 can keep its circular section by its own elasticity, and therefore contact of the conductive members 12 can be prevented even when the tubular switch is wound up with a hose reel or wound up and stacked. Further, even if the conductive members are mutually contacted, they can be separated by removing the external pressure at that location or giving internal pressure to restore the original shape.

The hose member 11 can restore its shape not only by its own restoring force, but also by internal pressure as mentioned above and restoring force of the coiled conductive member 12 or the both. Because of this automatic restoration function, it becomes possible to repeatedly use the tubular switch. Therefore, it can be used even for applications suffering high operation frequency, for example, frequency counters, velocity measurement apparatuses in which application two of the tubular switches are placed on a road surface and velocity of vehicles passing between them is measured.

This hose member 11 is preferably translucent or transparent. If so, break-down, deformation and the like of the conductive members 12 can be visibly examined from the outside.

Sensibility, resistible pressure, weight, flexibility etc. of the tubular switch 10 of this embodiment can be varied in wide ranges by varying the diameter, wall thickness, material, specific gravity of the hose member 11, coefficient of elasticity, wire diameter, material, number of lines, wire pitch and the like of the conductive member 12. Therefore, it can be adopted for various uses requiring various types of switches from small size sensitive ones to large scale ones for large load, and hence it has an extremely wide application range. For example, it can be used as a switch for automatic doors, a switch installed on appliances and operated by a load exceeding a certain level and the like.

The time required for the operation of this tubular switch 10 corresponds to the time required for obtaining electrical conduction within the conductive member 12. Therefore, even though the hose member 11 is lengthened, the operation time does not substantially changed, and one having even a length of several kilometers may also be used. It is also possible to closely install a large number of the tubular switches to detect invasion or passage of animals or humans. For close installation, the tubular switches may be disposed, for example, in parallel, in a grid pattern, wave form pattern, spiral pattern and the like.

This tubular switch 10 exhibits no directionality and has flexibility, and therefore it may be installed or disposed in an anfractuous shape. Further, because it is not affected by rain or wind, it can be disposed in the outdoors. Moreover, it can be easily transferred, dismounted, and installed.

As for this tubular switch 10, the hardness of the hose member 11 can be adjusted by varying the internal pressure, even when ambient temperature, e.g., atmospheric temperature is changed. Furthermore, by giving internal pressure with compressed air, it can be floated on a water surface to across a puddle or pass over a conduit, or prevented to be deformed by hydraulic pressure when used underwater.

Figure 2:
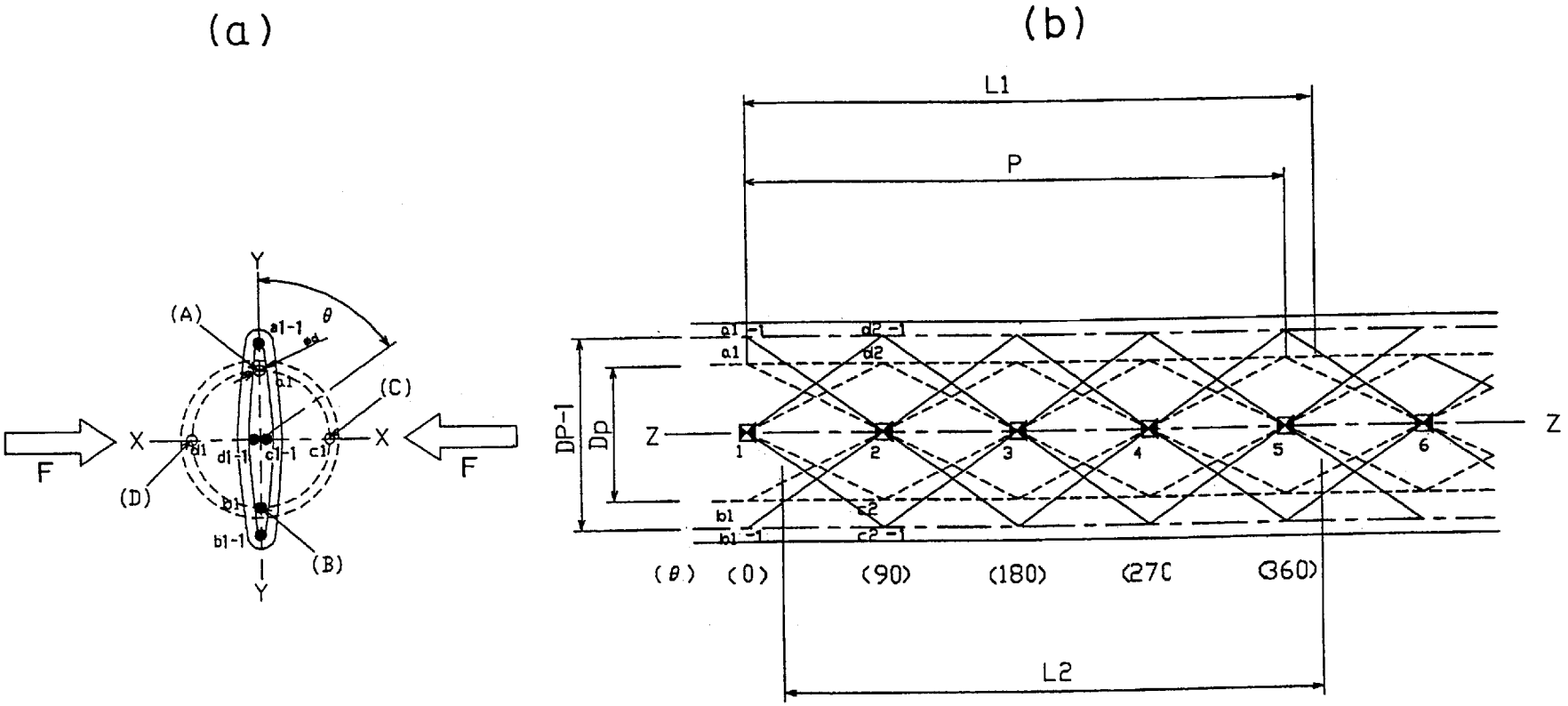
FIGS. 2(*a*) and (*b*) presents drawings for explaining the operation of the tubular switch according to the first embodiment of the present invention.

FIG. 2 presents drawings for explaining the action of the tubular switch of the present invention, where FIG. 2(*a*) is a sectional view and FIG. 2(*b*) is a side view. In FIG. 2(*a*), the spiral curves are represented as straight lines, and it is represented as a perspective view. The normal lines indicate switch-on state, and the broken lines indicate switch-off state.

The spiral conductive members (A) and (C) are on the power source side, and the conductive member (B) and (D) are on the load side. This drawing represents an example utilizing 4-line spirals, and the conductive members (A) and (B), and (C) and (D) are dephased by 180°, and the conductive members (A) and (C) are dephased by 90°. P represents a pitch.

When external pressure is not loaded, the switch maintains the shape indicated with the broken lines, and the conductive members (A), (B), (C), and (D) are separated from one another. As for the embodiment of FIG. 2, when the tubular switch 10 receives pressure F in the X-axis direction over the length L1 larger than the spiral pitch P, the tubular switch 10 is deformed into a shape indicated by the normal lines.

At this point, in the section 1, a1 transfers to a1-1, b1 to b1-1, c1 to c1-1, and dl to d1-1, and c1 and d1 are crossed and contacted with each other so that electric current can flow c1-1 to d1-1.

Similarly, a2-1 and b2-1 in the section 2, c3-1 and d3-1 in the section 3, a4-1 and b4-1 in the section 4, and c5-1 and d5-1 in section 5 are respectively crossed and contacted with each other to make current flow possible.

That is, in this case, there are five contact points. Similarly, within the range of L2, which is longer than P, there are 4 contact points at the sections 2, 3, 4 and 5.

When the tubular switch 10 was deformed, the diameter in the X direction becomes smaller, whereas the diameter of Y direction becomes larger by a length proportional to the decrease of the diameter in the X direction. Therefore, internal surface area of the tubular switch 10 is substantially unchanged, and there are no substantial dimensional change in the longitudinal direction. Accordingly, length of the spiral conductive members (A), (B), (C), and (D) are also substantially unchanged.

As for the conductive members (A), (B), (C), and (D), as the ratio of the spiral pitch P to the winding diameter Dp becomes larger, their length variation upon deformation becomes smaller, and hence slip between the internal surface of the hose member 11 and the conductive members becomes less likely to occur.

This means that, in order to make the minimum detection width in the longitudinal direction smaller, it is desirable to increase the number of wires constituting the spiral, and in order to make deformation stress of the conductive members of the spiral smaller, it is desirable to make the wire diameter $\phi$ d of the conductive members smaller, and make the pitch P larger.

By suitably adjusting the factors involved in the aforementioned relationship, the difference of length variation between the hose member and the conductive members upon deformation can be compensated by flexibility of the hose member and the conductive members.

(Second Embodiment)

Figure 3:
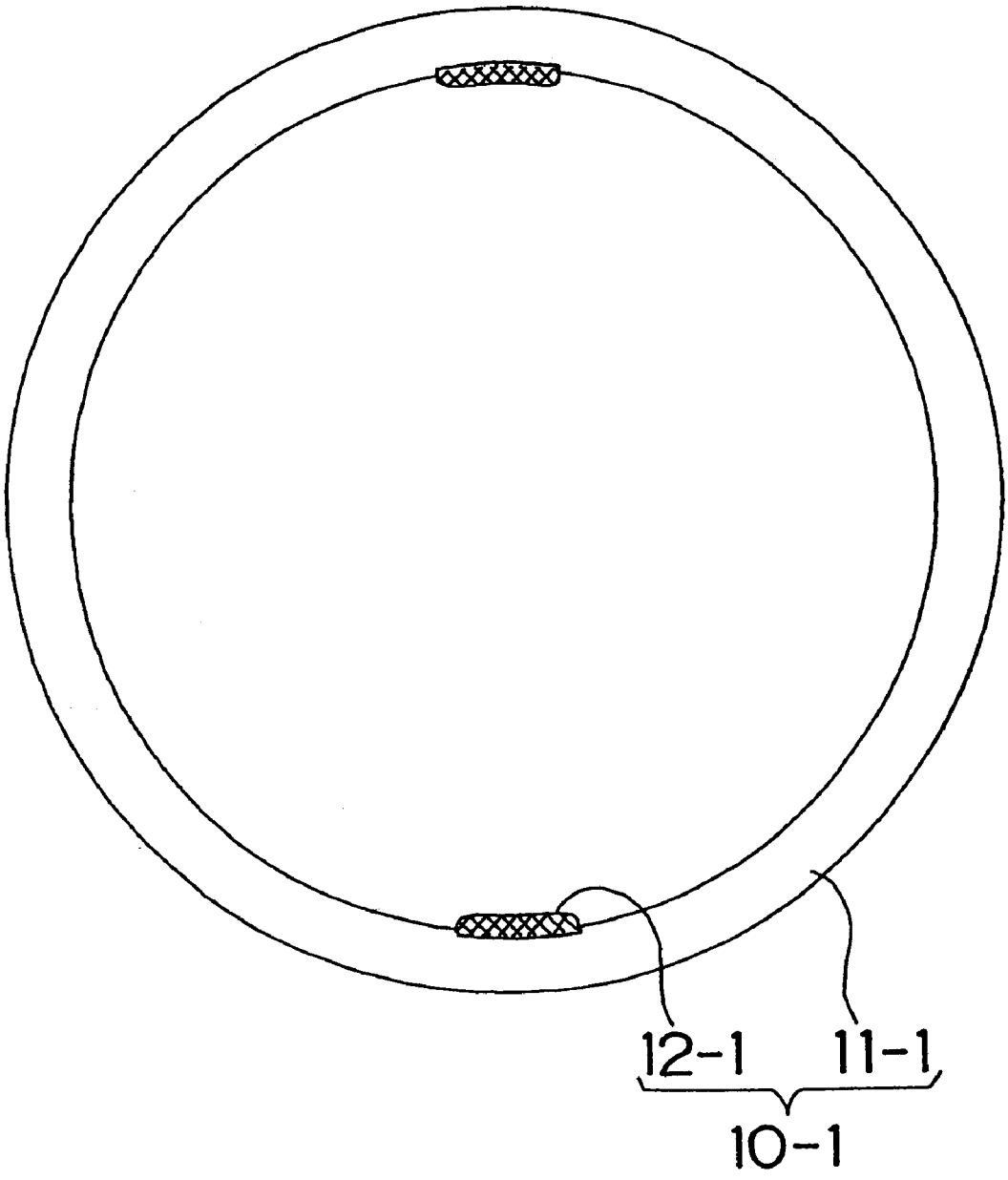
FIG. 3 presents a sectional view representing the third embodiment of the tubular switch of the present invention.

FIG. 3 is a sectional view representing the second embodiment of tubular switch of the present invention.

In the embodiments explained hereinafter, exactly the same numbering as the first embodiment or the same numbering as the first embodiment with appended numbering identical in each embodiment is occasionally used for parts functioning as those corresponding thereto in the first embodiment so as to obviate redundant explanation.

In this tubular switch 10-1, the conductive member 12-1 composed of metal wire mesh is directly jointed to the internal surface of the hose member 11-1 made of a rubber. The hose member 11-1 can penetrate into the mesh to retain the conductive member 12-1, i.e., exerts anchoring effect.

(Third Embodiment of Tubular Switch)

In the third embodiment, the hose member 11 may be a light and soft member which is made of fabric cloth formed in a tubular shape, of which internal surface is coated with rubber or resin, like a water supplying hose for fire fighting.

In this case, the hose member can be readily prepared by applying rubber or resin on the outside of a cloth tube, winding a plurality of the conductive members 12 wound around the tube, adhering and fixing the conductive members on the surface of the tube, and reversing the tube so that the cloth surface should become external surface.

In this embodiment, when the hose member 11 is disposed, because the hose member itself does not have restring force, it is necessary to apply internal pressure to inflate the tubular switch 10 so that the spiral conductive member 12 should be kept in the off-state. The conductive member is preferably fine and highly flexible flat woven copper wires.

The tubular switch made of cloth according to the third embodiment is light and highly flexible. Therefore, its handling is easy, and its practical applicability is excellent.

(Fourth Embodiment of Tubular Switch)

Figure 4:
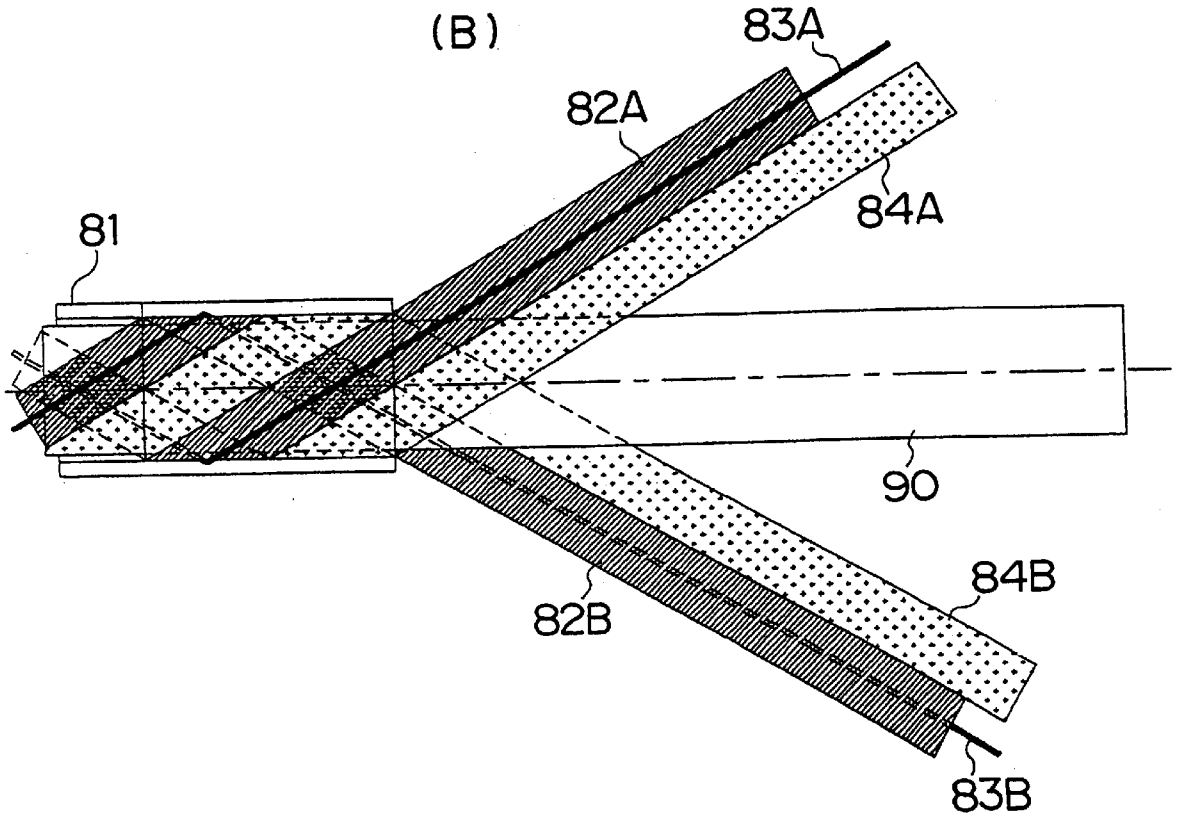
FIGS. 4(*a*) and (*b*) presents sectional views representing the fourth embodiment of the tubular switch of the present invention.
Figure 4:
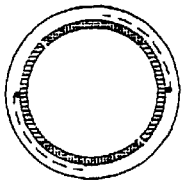

FIG. 4 presents drawings representing the fourth embodiment of the tubular switch of the present invention.

The tubular switch 80 of the fourth embodiment is prepared by winding two pieces of conductive rubber plates 82A and 82B in belt-like shape having flexibility and elasticity and two pieces of insulation rubber plates 84A and 84B in belt-like shape having flexibility and elasticity on an arbor (mandrel) 90 alternately as four-line spiral (first winding step), spirally winding a bare electric wires 83A and 83B composed of soft copper twisted wires on the external surface of the conductive rubber plates 82A and 82B (second winding step), and covering the external surfaces of the conductive rubber plates 82, the bare electric wires 83, and the insulation rubber plates 84 with insulation rubber for covering (hose member) 81 (covering step).

According to the forth embodiment, the bare electric wires 83 are not fused to the conductive rubber plates 82, the insulation rubber plates 84, and the insulation rubber for covering 81, but can be contacted with the rubber plates 82 to afford electric continuity because the rubber members 82, 84, and 81 can be integrated by curing step (by heating).

Further, in this tubular switch 80, electric continuity can be realized by the contact between the conductive rubber plates 82. In this case, because the contact area between the conductive rubber plates 82 is large, undetectable region becomes smaller. Moreover, the bearing stress becomes smaller, and the contact becomes softer compared with the contact between the bare electric wires 83, and hence break down becomes less likely to occur. Accordingly, the switch can be repeatedly used, and its lifetime is prolonged.

In this case, the conductive rubber plates 82 have a relatively high electric resistance. However, the conduction distance at the contact region is small, i.e., corresponds to the thickness of the plates, and, in longitudinal direction of the tubular switch 80, electric continuity is realized by the bare electric wires 83 whose electric resistance is extremely low. Therefore, the electric resistance of the conductive rubber plate does not degrade the function of the switch.

Even if the bare electric wires 83 are broken down, electric conduction is maintained by the conductive rubber plate 82, and hence the function of the switch can be maintained.

When it becomes difficult to pull out the iron core 90 after the curing, compressed air may be introduced into the hose member to expand its internal diameter and then the iron core 90 may be pulled out.

Further, in the fourth embodiment, the conductive rubber plates 82 alone may be wound around the arbor 90 with a defined gap (first winding step). Alternatively, it is also possible to wind the conductive rubber plates 82 and insulation plates as described above, and then peel off the insulation plates afterward. In this case, the insulation plates may be composed of a material not adhered to rubber.

While the bare electric wires 83 were explained by exemplifying the retractile mesh wire, it may be folded in a corrugated form, or woven in a tubular form.

Instead of the conductive rubber plates 82 and the bare electric wires 84, a conductive rubber tube which is composed of bare electric wires coated with conductive rubber may also be used.

In this embodiment, similar function can be obtained by using a conductive resin instead of the conductive rubber. As the insulation material such as for coating, other materials may also be used.

In the fourth embodiment, when the arbor 90 is pulled out after the curing, it may become difficult to pull out the arbor 90 because of the friction between the arbor 90 and the internal surface of the hose member.

To solve this problem, a hose made of resin and preliminarily inflated by enclosing a fluid such as compression gas or liquid may be used as the arbor 90. After the curing, the internal pressure may be released to reduce the external diameter of the arbor 90 of the resin hose, and thus reduce the friction with respect to the internal surface of the hose member. Then, the arbor 90 may be pulled out.

The arbor of the resin hose and the internal surface of the hose member are not fused even after the curing step.

(Fifth Embodiment of Tubular Switch)

Figure 5:
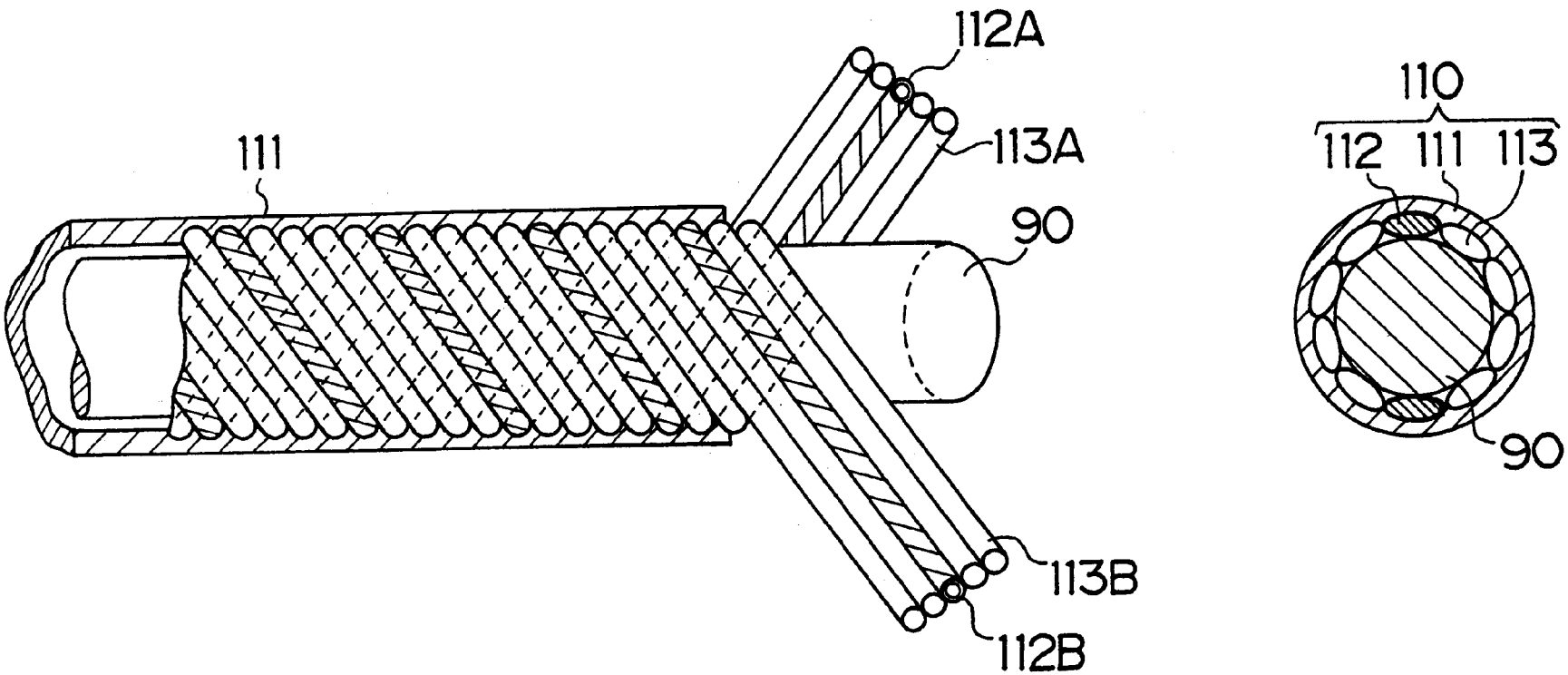
FIG. 5 presents drawings representing the fifth embodiment of the tubular switch of the present invention.

FIG. 5 presents drawings representing the fifth embodiment of the tubular switch of the present invention.

The tubular switch 110 of the fifth embodiment is prepared by spirally winding a belt comprising one conductive member 112A composed of woven copper wires having flexibility and elasticity or the like and four insulation members 113A composed of insulation rubber or resin cord or the like wherein two of the insulation members are disposed each side of the conductive member 112A without gap, and another belt comprising similar conductive member 112B and insulation members 113B alternately on an arbor (mandrel) 90 without gap (winding step), and covering the aforementioned components with a hose member 111 composed of insulating rubber or resin for covering(covering step).

By winding the belts without gap during the winding step, the hose member 111 is prevented from penetrating between the conductive member 112 and the mandrel 90, and thus the conductive members 112 can be exposed to the inside of the hose.

Figure 6:
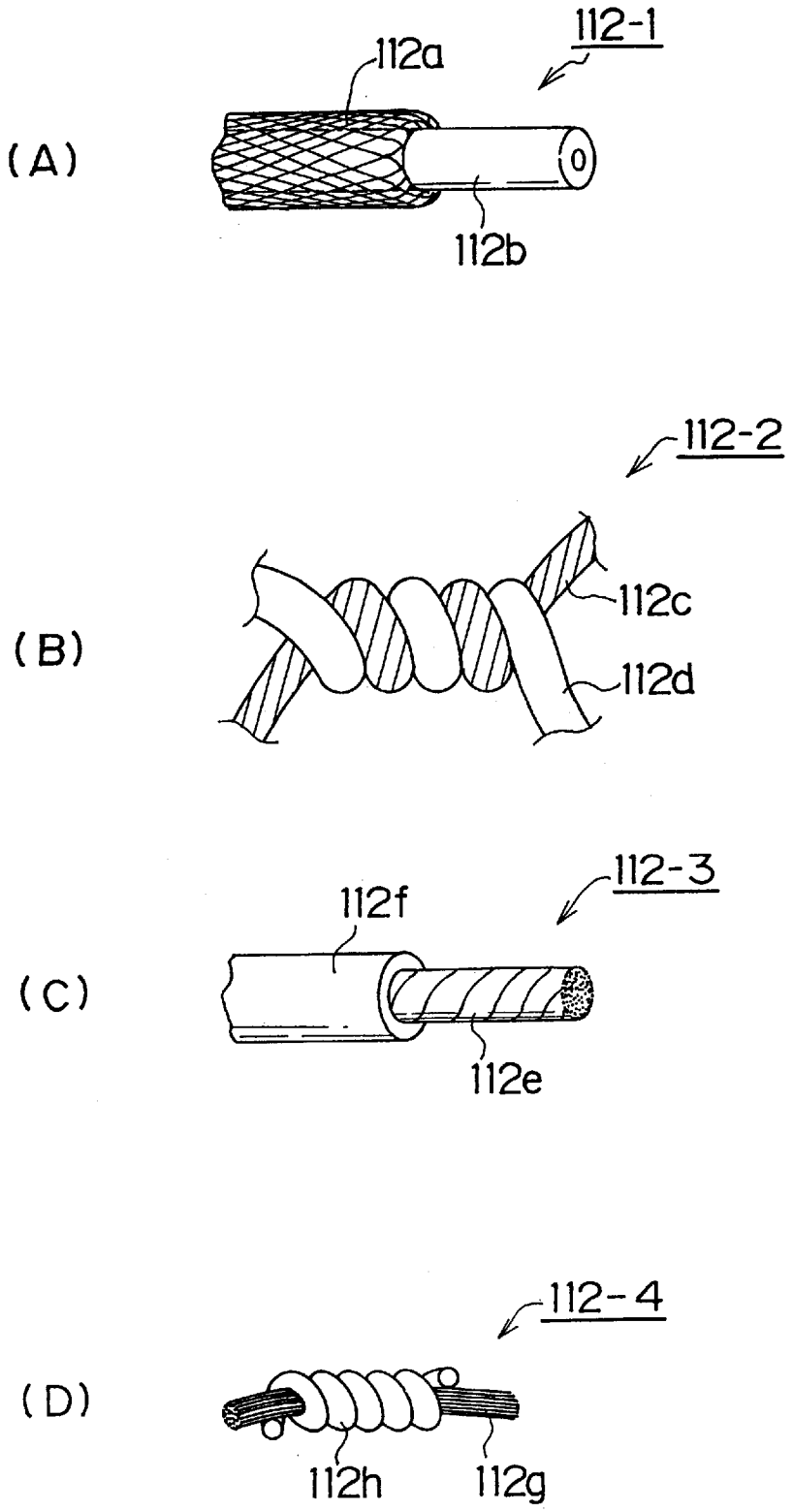
FIGS. 6(*a*) and (*d*) presents drawings representing examples of the conductive member used in the fifth embodiment of the tubular switch of the present invention.

FIG. 6 presents drawings of examples of the conductive member of the fifth embodiment.

Because a metal wire such as copper wire, for example, is used for the conductive member 112, it is not adhered to the hose member 111 composed of a rubber or resin. Therefore, in this embodiment, the metal wire is retained on the internal surface of the hose member 111 using a joint member composed of a material similar to that of the hose member 111.

Figure 7:
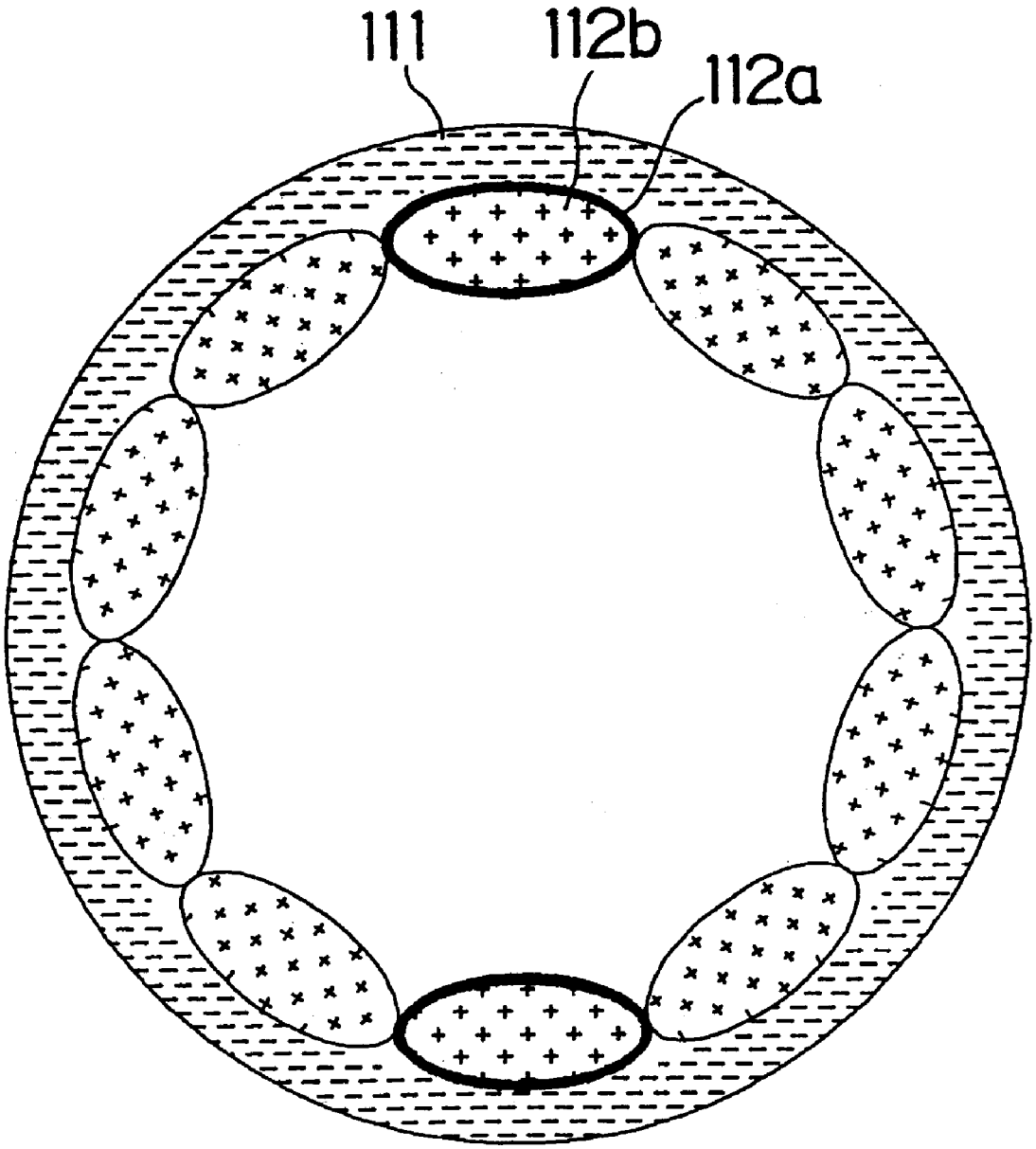
FIG. 7 presents a sectional view representing a tubular switch utilizing the conducting member of FIG. 6(A) (when the cord is solid).
Figure 8:
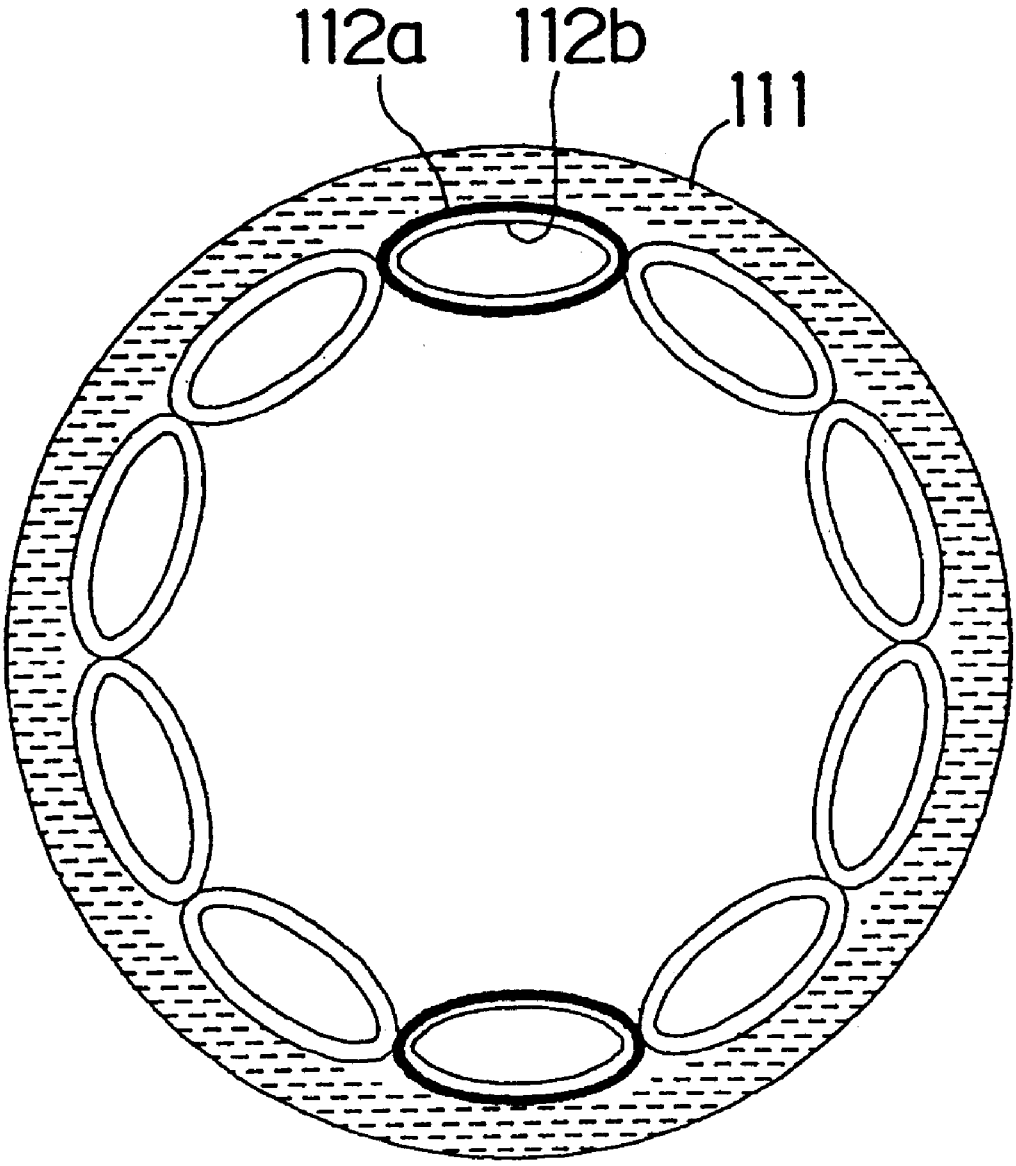
FIG. 8 presents a sectional view representing a tubular switch utilizing the conducting member of FIG. 6(A) (when the cord is a tube).

The conductive member 112-1 shown in FIG. 6(A) consists of a mesh tubular body 112*a* composed of metal wires coarsely bias-woven in a tubular shape (conductive member) inserted with a cord composed of a material similar to that of the hose member 111 (joint member). FIGS. 7 and 8 present sectional views of tubular switches utilizing the conductive member of FIG. 6 (A), and FIG. 7 is for the case where the cord is solid and FIG. 8 for the case where the cord is hollow (tube).

In these cases, because the mesh tubular body 112*b* is inserted with the cord 112*a* therein, it can be wound on the arbor 90 while maintaining a diameter larger than that when it is maximally elongated along its longitudinal direction. Therefore, when the mesh tubular body 112*a* is wound on the arbor 90, tensile force is applied to the mesh tubular body 112*a*, but the mesh tubular body 112*a* is prevented from being maximally extended by the tensile force because the cord 112*b* is inserted therein.

Thus, it becomes possible for the mesh tubular body 112*a* to expand and contract following the expansion and contraction of the hose member 111, and break down or separation from the hose member 111 of the mesh tubular body 112*a* caused by directly receiving the tensile force applied to the hose member 111 can be prevented.

Further, because the material of the cord 112*b*, rubber or resin, and the internal surface of the hose member 111 are fused or adhered to each other through the mesh of the mesh tubular body 112*a*, the mesh tubular body 112*a* is surely retained on the internal surface of the hose member 111.

Moreover, when the hose member 111 is deformed by received external force, and the spiral conductive members 112 provided therein are crossed and contacted (switch-on state), the cord 112*b* composed of rubber or resin can work as a cushion material and absorb the bearing stress to prevent break down of the metal wires constituting the mesh tubular body 112*a*.

Furthermore, because the conductive member 112-1 can expand and contract, when the arbor 90 is pulled out after the production, compressed air, high pressure water or the like can be introduced into the hose member 111 to expand the inner diameter of the hose member 111, and concurrently the arbor 90 can be pushed out. Thus the operation can be performed easily.

The conductive member 112-2 shown in FIG. 6(B) is composed of a metal wire 112*c* having no or little elasticity such as monofilament wires, twisted wires, and flat mesh wires of copper wires, and a cord 112*d* composed of a rubber or resin material having conductivity and similar to the material of the hose member 111 (joint member), which are twisted together.

In this case, by fusing or adhering the cord 112*d* on the internal surface of the hose member 111, the metal wire 112*c* is surely retained on the internal surface of the hose member 111.

Like the conductive member 112-1, the metal wire 112*c* and the cord 112*d* also contribute to prevention of break down of the wires and easiness of pulling out the arbor 90, because they are twisted together and hence can expand and contract.

Figure 9:
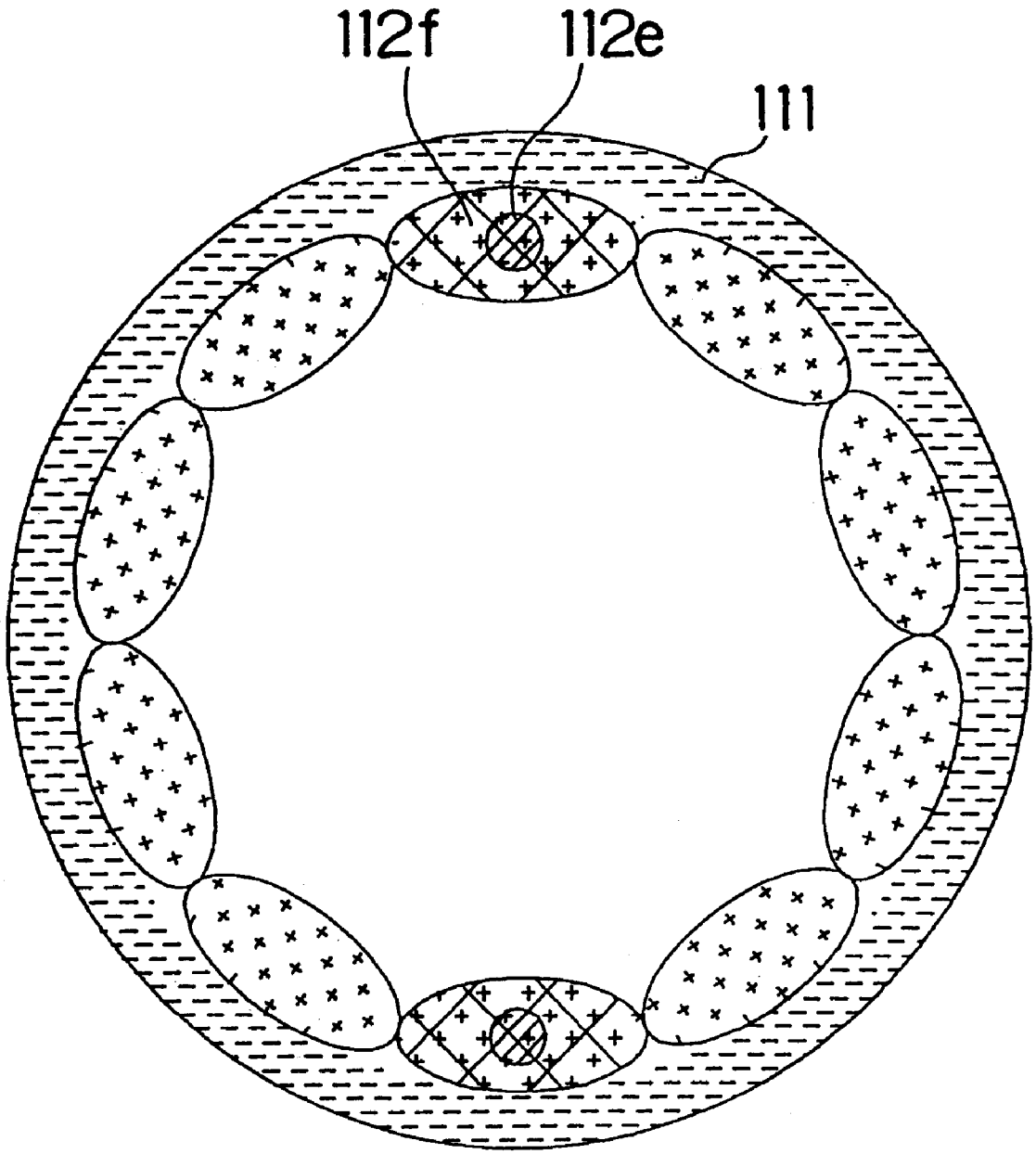
FIG. 9 presents a sectional view representing a tubular switch utilizing the conducting member of FIG. 6(C).

The conductive member 112-3 shown in FIG. 6(C) is composed of a metal wire 112*e* covered with a rubber or resin material 112*f* similar to the material of the hose member 111 (joint member). FIG. 9 is a sectional view of a tubular switch utilizing the conductive member of FIG. 6(C).

The conductive member 112-4 shown in FIG. 6(D) is composed of a metal wire 112*g* covered with a rubber or resin material 112*h* similar to the material of the hose member 111 (joint member) spirally wound around the metal wire 112*g*.

For the conductive members 112-3 and 112-4, the joint members must have conductivity, whereas they may not necessarily have conductivity for the conductive members 112-1 and 112-2.

Material of the hose member 111 will be explained hereinafter. The hose member 111 can be produced with a rubber or resin such as vinyl resin.

When it was produced with a rubber, it exhibits good elasticity, antiweatherability, strength etc. When it is produced with a resin, it exhibit good appearance, transparency, moldability, thermoplasticity, and productivity (low cost).

Therefore, the material can be suitably selected, for example, resins can be selected for applications under relatively mild condition (indoors, inside of cases etc.), and durable rubbers for applications under severe conditions (outdoors etc. where temperature and humidity markedly change).

If it is transparent, break down etc. inside the hose can be visibly observed from the outside, and hence its maintenance is easy. Depending the place of use, it may be imparted with colorful decoration such as stripes in yellow and black to attract attention by the switch itself.

Whichever material is used, an inert gas can be enclosed in the hose to prevent corrosion of the bare electric wire. Further, even if the contact point sparks when the conductive members are contacted (switch-on), it completely prevent those objects outside of the member from catching fire, and provides marked explosion-proof property. Furthermore, if the hose is installed in water, oil, or other liquids, they do not penetrate into the inside, and it can be used safely.

(Sixth Embodiment of Tubular Switch)

FIGS. 10 to 13 present sectional views of tubular switches according to the sixth embodiment of the present invention.

In the sixth embodiment, a luminescent member 114 or a light reflecting member 115 is provided in the hose member 111 or the joint members 112 and 113 or on the internal or external surface of the members.

Figure 10:
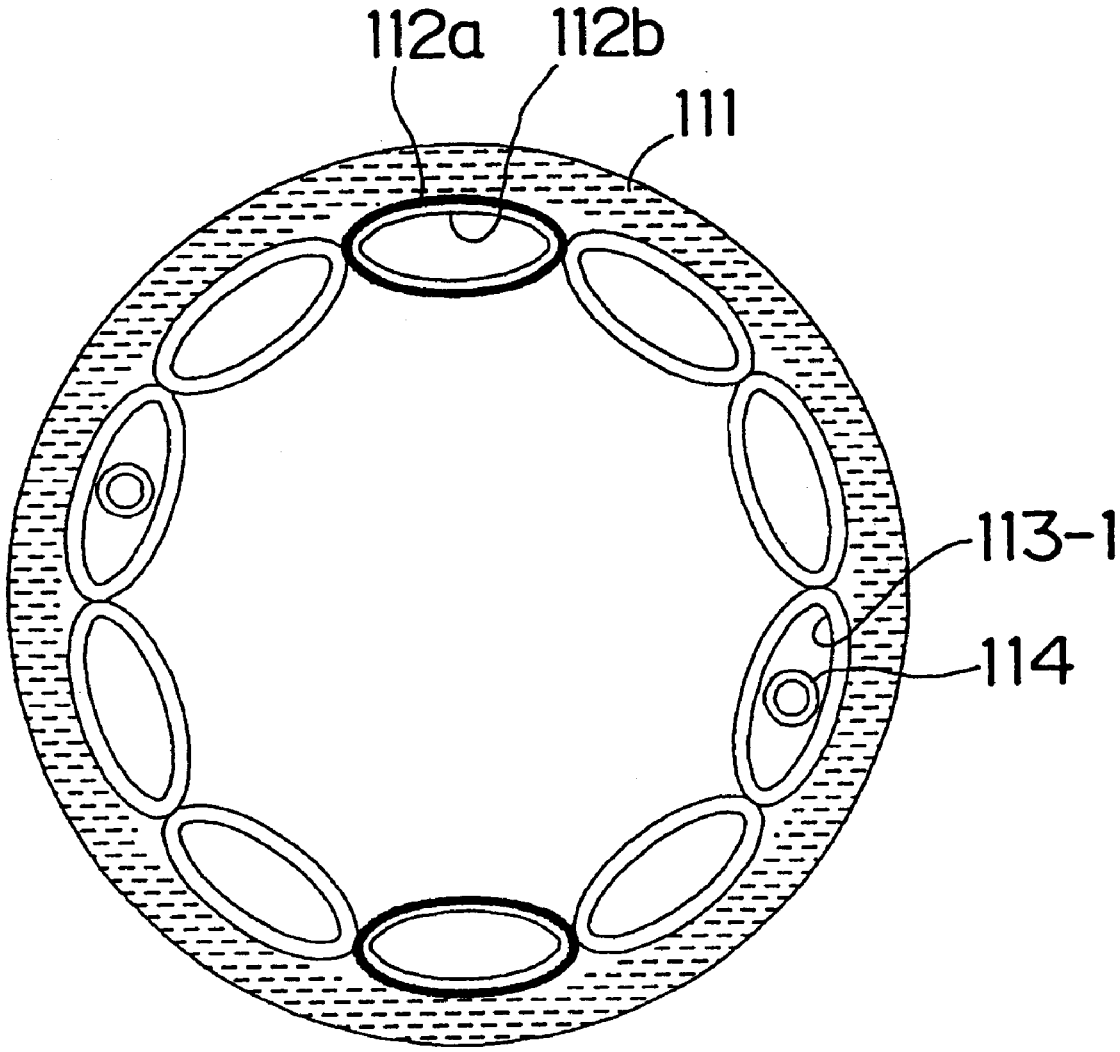
FIG. 10 presents a sectional view representing the sixth embodiment of the tubular switch of the present invention (when the luminescent member is provided in the joint member).
Figure 11:
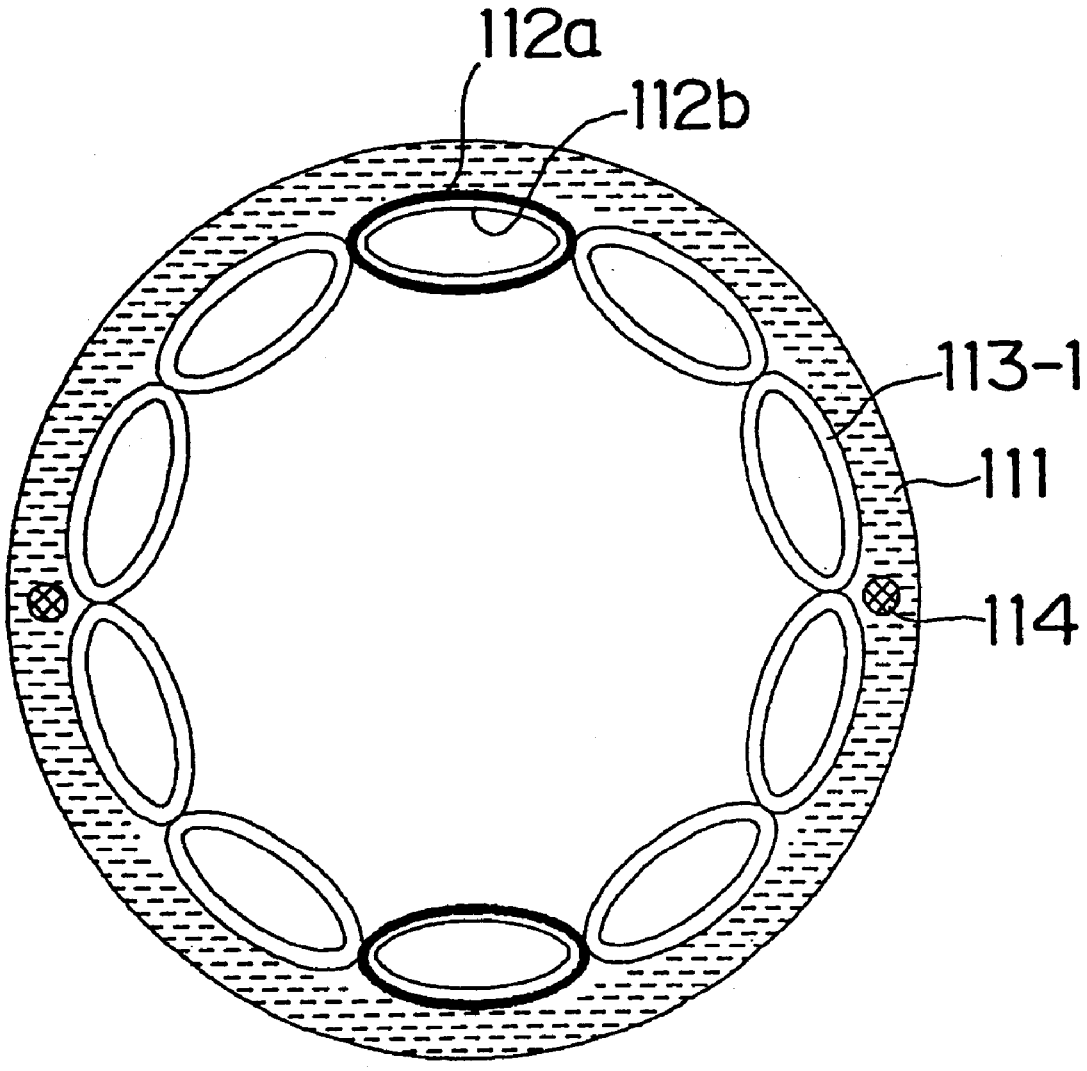
FIG. 11 presents a sectional view representing the sixth embodiment of the tubular switch of the present invention (when the luminescent member is provided in the hose member).
Figure 12:
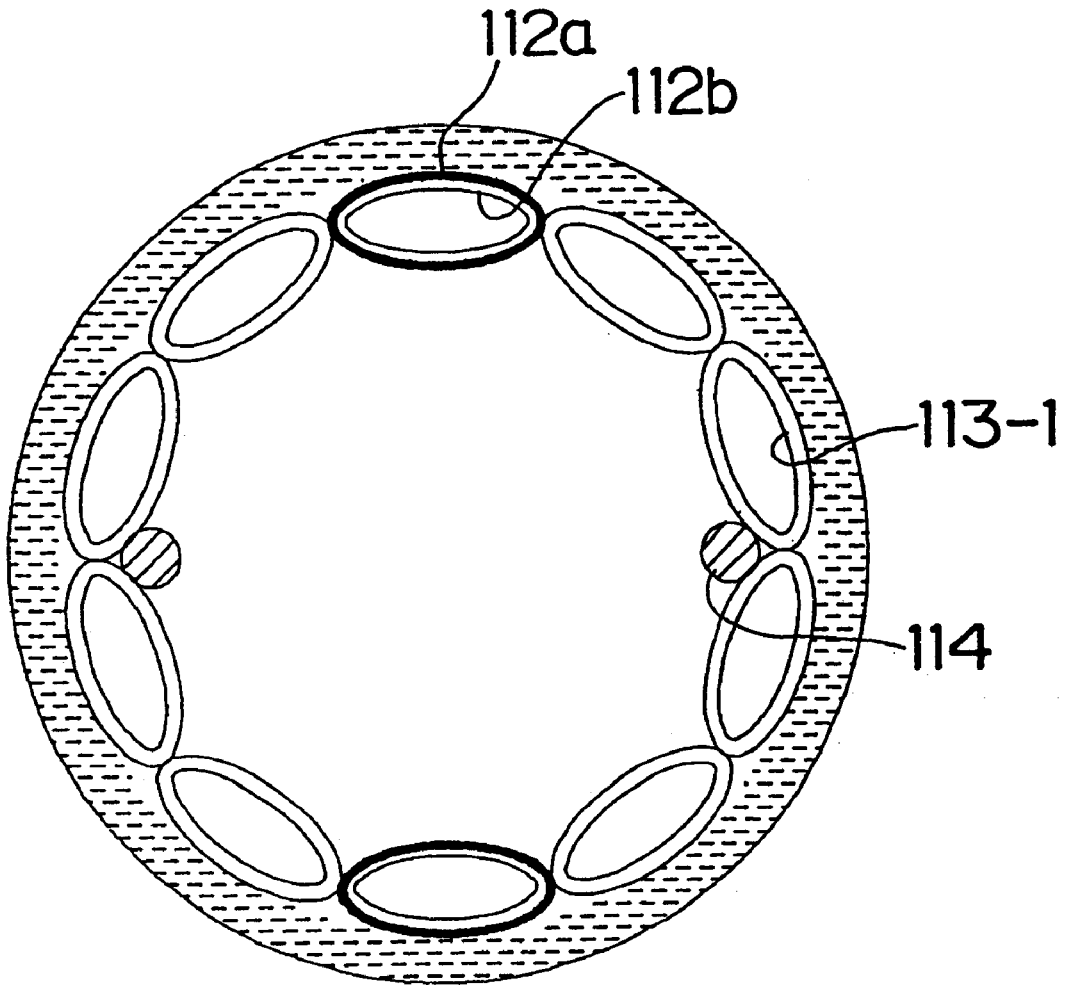
FIG. 12 presents a sectional view representing the sixth embodiment of the tubular switch of the present invention (when the luminescent member is provided inside the hose member).

Specifically, the luminescent member 114 may be provided in an insulating tube 113-1 as shown in FIG. 10, or it may be embedded in the hose member 111 as shown in FIG. 11. It may also be provided outside the insulating tube 113-1 (inside the hose) as shown in FIG. 12. In these cases, a transparent or translucent material is used for the hose member 111 and joint members 112 and 113.

As the luminescent member 114, for example, one in a rope-like shape consisting of a core electrode, a transparent electrode and a luminescent layer in a pipe-like shape provided between the electrodes where an AC voltage is applied between the both electrodes so that the layer should emit light and the like can be used (see, Japanese Patent Unexamined Publication No. Hei 6-236797).

Figure 13:
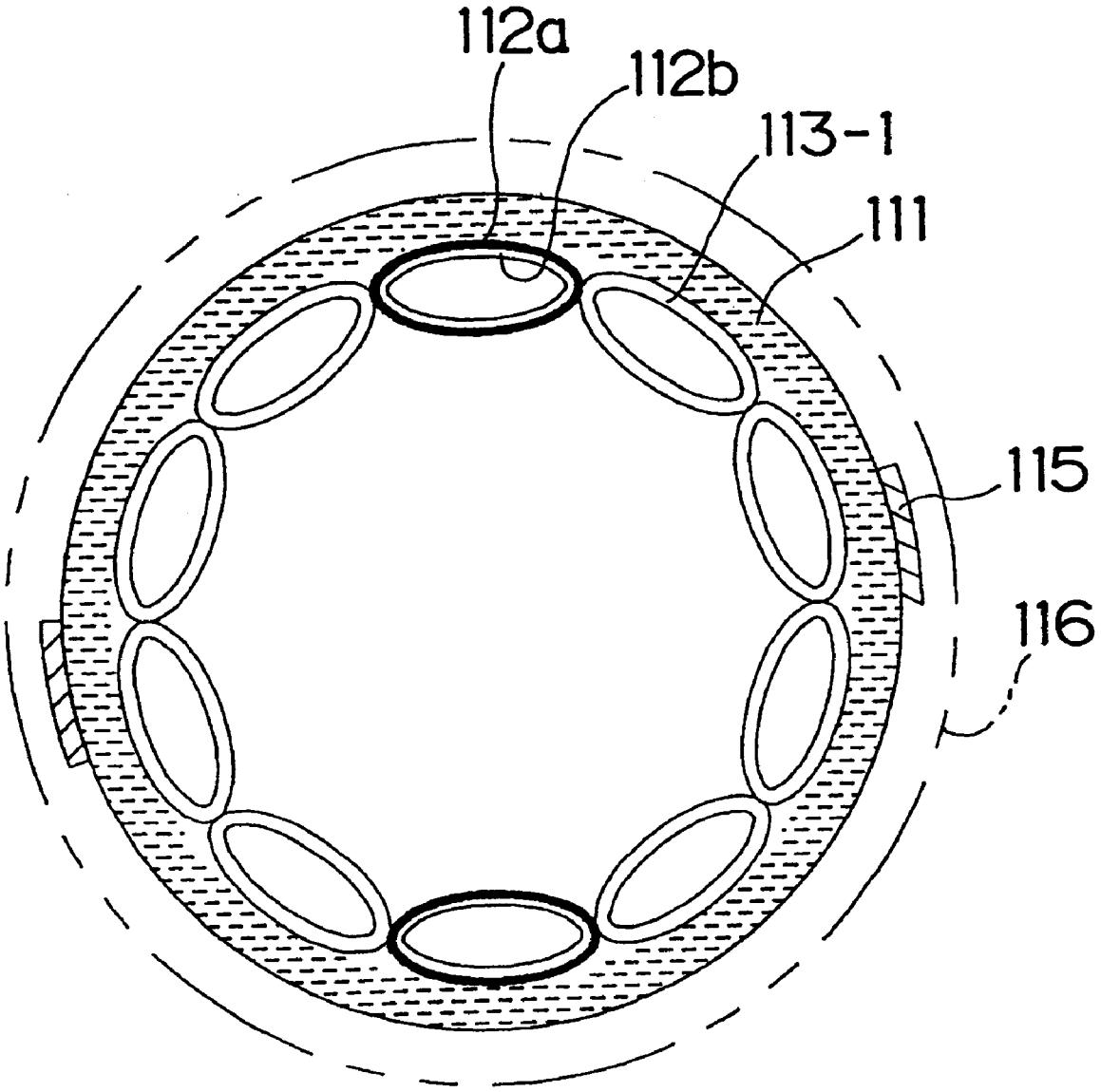
FIG. 13 presents a sectional view representing the sixth embodiment of the tubular switch of the present invention (when a light reflecting member is provided).

On the other hand, the light reflecting member 115 is affixed to the external surface of the hose member 111 as shown in FIG. 13. In this case, it is desirable that the external surface of the light reflecting member 115 should be coated with a transparent protection member 116.

According to this embodiment, presence of the tubular switch 110 can be recognized by the light emission of the luminescent member 114 or reflected light from the light reflecting member 115. Therefore, it is suitable for applications in dark places.

(Seventh Embodiment of Tubular Switch)

Figure 14:
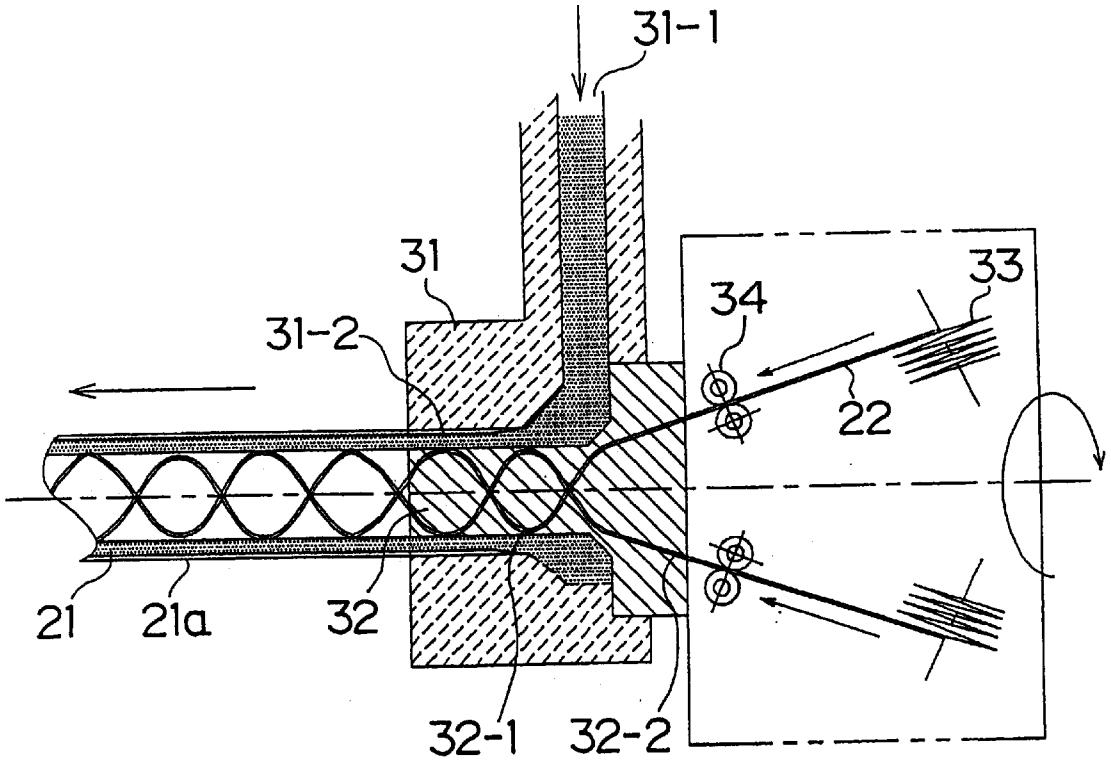
FIGS. 14(*a*) and (*b*) presents drawings for explaining the seventh embodiment of the tubular switch of the present invention.
Figure 14:
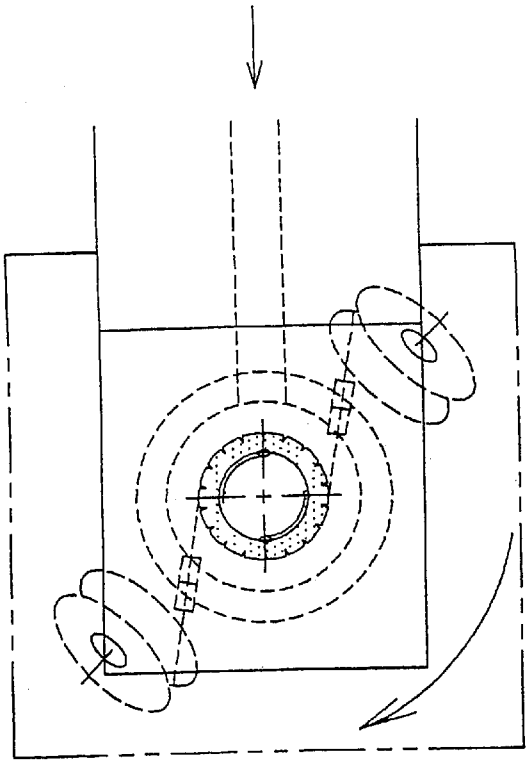

FIG. 14 presents drawings for explaining the seventh embodiment of the tubular switch of the present invention.

In this tubular switch 20, a groove 21*a* is formed on the external surface of the hose member 21 along its longitudinal direction. This groove 21*a* is for making the hose member 21 more likely to be deformed so that the sensitivity of the switch should be improved.

Method for forming the groove 21*a* will be explained by exemplifying an apparatus for producing this tubular switch 20.

This tubular switch 20 is produced by a production apparatus comprising fixed external nozzle member 31, and an internal nozzle member 32 which is disposed in the hollow of the external nozzle member 31 with a gap and rotated. A material for the hose is introduced by pressure from a feeding aperture 31-1 of the external nozzle member 31, and the hose member 21 is extruded in a tubular shape from the gap between the external nozzle member 31 and the internal nozzle member 32. Concurrently, a groove 21*a* is formed straight on the external surface of the hose member 21 by a projection 31-2 protruding to the gap from the internal surface of the external nozzle member 31.

On the other hand, a bare electric wire 22 wound up in a reel 33 is fed to a spiral groove 32-1 formed on the external surface of the internal nozzle member 32 through a pore 32-2 by a feeding apparatus 34. The internal nozzle member 32 rotates in the hollow of the external nozzle member 31, and spirally feeds and affixes the bare electric wire 22 on the internal surface of the hose member 21 with a spiral pitch of the internal nozzle member 32. During this operation, extruding speed of the hose member 21 should correspond to feeding speed of the bare electric wire 22 along the direction of the center axis.

As described above, in the tubular switch 20 of this embodiment, the straight groove 21*a* is formed on the external surface of the hose member 21 along its longitudinal direction. This groove 21*a* plays a role of a guide preventing the hose member 21 from rotating with the rotation of the internal nozzle member 32. It also reduces the resistance of the hose member 21 against deformation (hardness).

(Eighth Embodiment of Tubular Switch)

Figure 15:
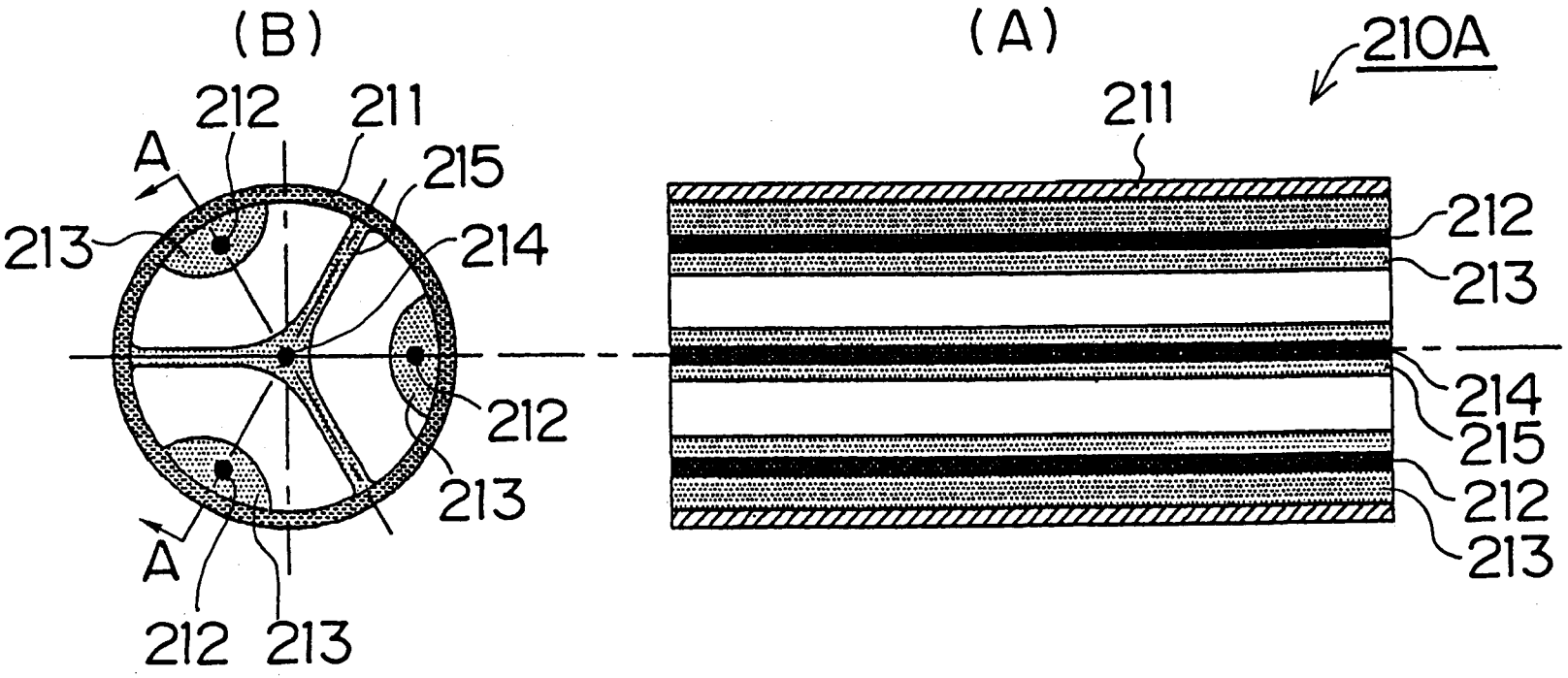
FIGS. 15(*a*) and (*b*) presents drawings representing the eighth embodiment of the tubular switch of the present invention.

FIG. 15 presents drawings representing the eighth embodiment of the tubular switch of the present invention.

This tubular switch 210 comprises a hose member 211 formed in a tubular form with an insulating rubber or insulating resin having elasticity, a plurality of first conductive members 212 having flexibility (three in this example) disposed on the internal surface of the hose member 211 along its longitudinal direction, first joint members 213 having conductivity and elasticity which are composed of a conductive rubber or conductive resin and joints the first conductive members 212 to the hose member 211, a second conductive member 214 having flexibility which is disposed around the center of the radial section of the hose member 211 along its longitudinal direction, second joint members 215 having conductivity and elasticity which is composed of a conductive rubber or conductive resin and disposed so that they should not be in contact with the first joint members 213 and support the second conductive member with supporting membranes having a radially extended section in the radial section of the hose member and the like.

The conductive members 212 and 214 are linearly disposed along the longitudinal direction of the hose member 121. The hose member 121 and the joint members 213 and 215 are composed of similar kinds of resins or rubbers which can be fused to each other.

In the tubular switch of this embodiment, when the hose member 121 is deformed, any of the outer first joint members 213 may be contacted with the central second joint members 215, thereby the conductive members 212 and 214 are contacted with each other to afford electrical continuity, and thus the deformation can be detected.

When the tubular switch of this embodiment is produced by extrusion, the step of pulling out an arbor (mandrel) is not required. Therefore, in such a case, the conductive members 212 and 214 may not have elasticity if they have flexibility.

Figure 16:
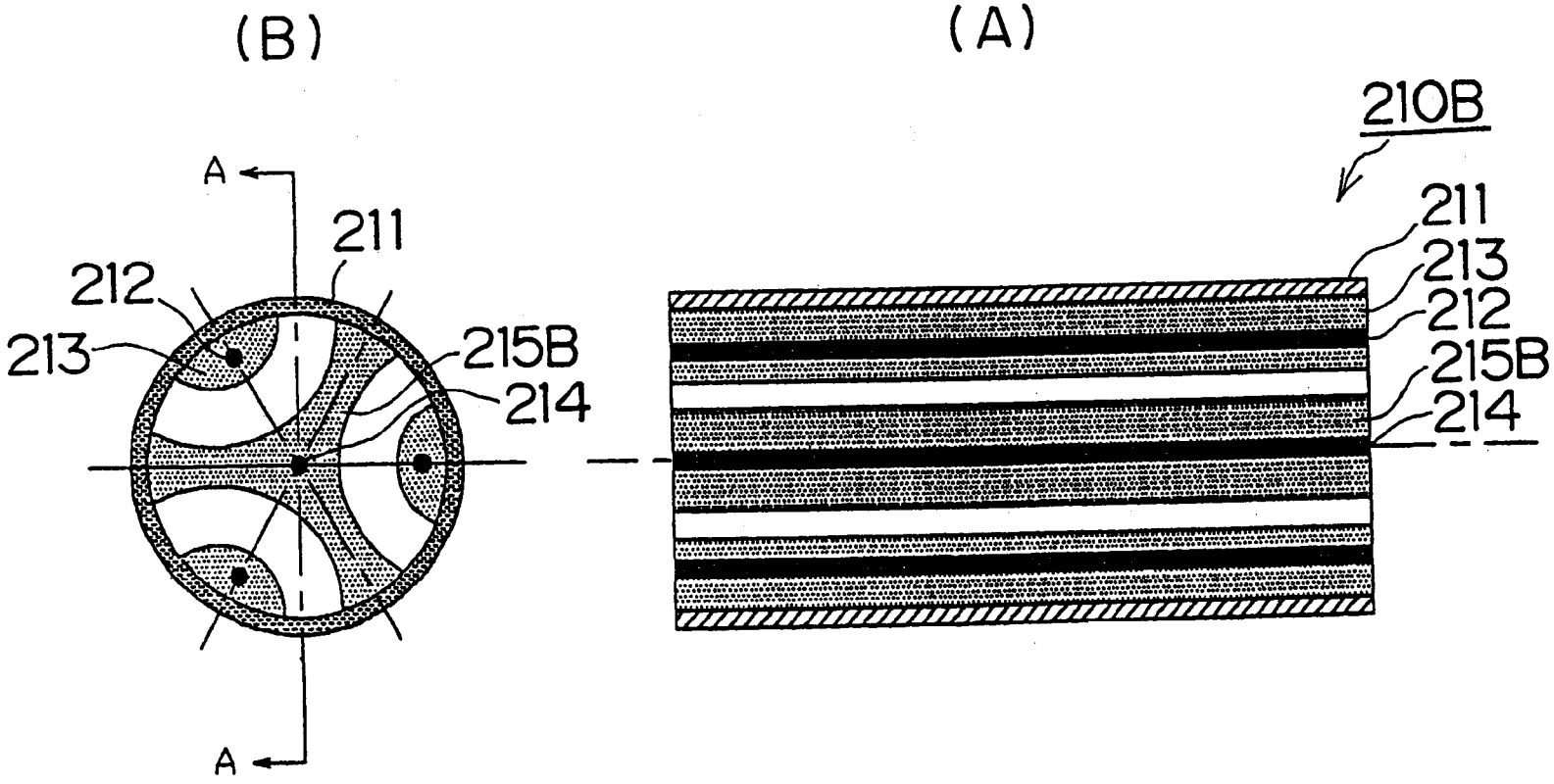
FIGS. 16(*a*) and (*b*) presents drawings representing a variation of the eighth embodiment of the tubular switch of the present invention.

FIG. 16 presents drawings showing a variation of the eighth embodiment of tubular switch of the present invention.

This tubular switch 210B has the same structure as the one shown in FIG. 15, except that the thickness of the support membranes of the second joint members 215B is made thicker.

Like this embodiment, degree of the easiness of deformation of the hose, i.e., sensitivity of the switch can be controlled by adjusting the thickness of the support membranes of the second joint member.

(First Embodiment of Connecting Device)

Figure 17:
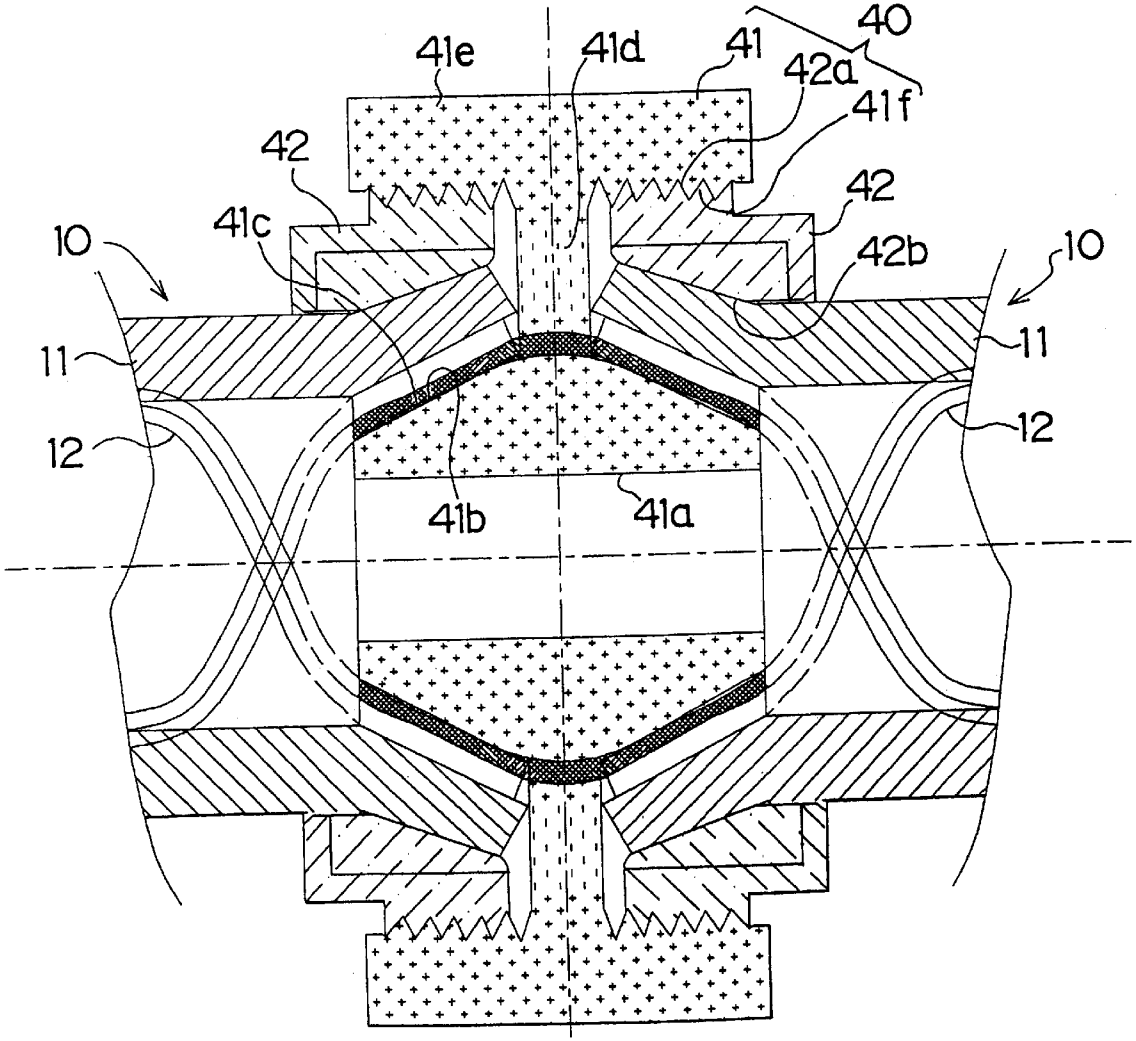
FIG. 17 presents a sectional view representing the first embodiment of the connecting device for tubular switches of the present invention.

FIG. 17 is a sectional view representing the first embodiment of the connecting device for tubular switches of the present invention.

The connecting device 40 is a device for connecting tubular switches 10 (20 etc.) of the present invention, and consists of a main body 41, clamping members 42 and so on.

The main body 41 comprises a center ball portion having a central hollow 41*a* and tapered parts 41*b*. On the tapered parts 41*b*, there are spirally formed electrodes 41*c* so as to follow the conductive members 12 of the tubular switch 10. A ring part 41*d* is formed on the center of the external surface of tapered part 41*b*, and flange parts 41*e* are further formed on its external surface. Inside the flange parts 41*e*, there are formed female screw parts 41*f*. The electrodes 41*c* are provided so as to penetrate the circular ring part 41*d*.

The clamping members 42 are disposed on the both sides of the main body 41, on which external surfaces male screw parts 42*a* are formed to be screw engaged with the female screw parts 41*f*, and have tapered internal surfaces 42*b*.

Into this connecting device 40, the tubular switches 10 are inserted so that the conductive members 12 should be put on the electrodes 41*c* of the main body 41, pinched by the main body 41 and the clamping members 43, and tightened by screwing the male screw parts 42*a* into the female screw parts 41*f*.

This connecting device 40 can be used not only when the tubular switches 10 are connected and used in a longer length, but also when a damaged part of the tubular switch 10 is removed and the tubular switches 10 of the both sides of the damaged part are connected. In such a case, the damaged part is easily repaired, and connected systems are restored quickly. Furthermore, even when a part of the tubular switch is damaged, it can be repaired and used repeatedly without discarding it as a whole, and therefore it is economically advantageous.

(Second Embodiment of Connecting Device)

Figure 18:
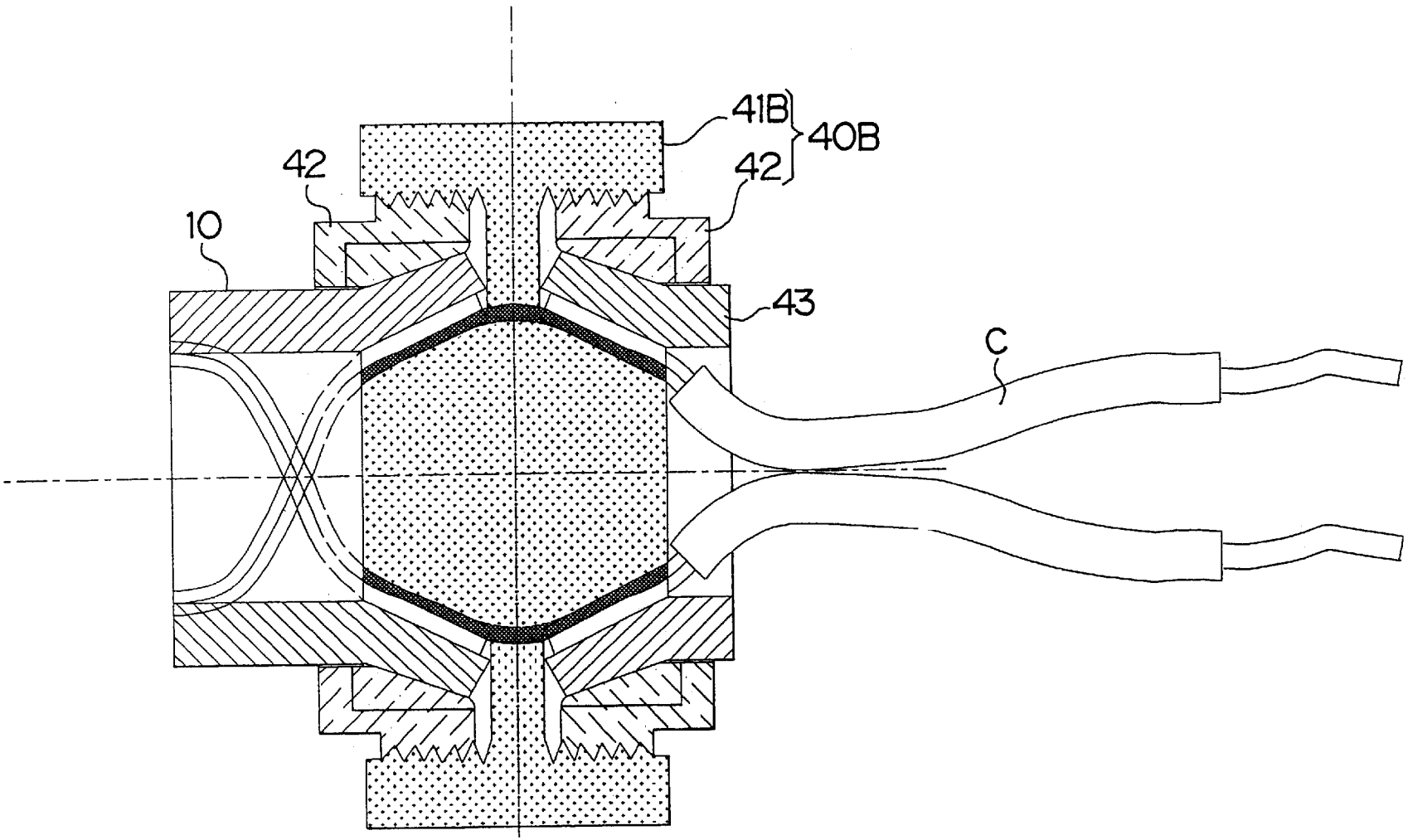
FIG. 18 presents a sectional view representing the second embodiment of the connecting device for tubular switches of the present invention.

FIG. 18 is a sectional view representing the second embodiment of the connecting device of tubular switches of the present invention.

This connecting device 40B of the second embodiment is a device for connecting a tubular switch 10 with cables C for inputting or outputting a switching signal of the tubular switch 10, it has a center ball part which does not have a hollow and, in addition to the components of the first embodiment, a dummy hose 43. As for the side of the tubular switch 10 of the connecting device 40B, they are connected in the same manner as the first embodiment. As for the cable C side, the dummy hose 43 of a short length, which acts as a packing, is pinched between the main body 41 and the clamping member 42, and tightened. When the diameter of the cable C is large, the dummy hose ring 43 may be omitted.

(Third Embodiment of Connecting Device)

Figure 19:
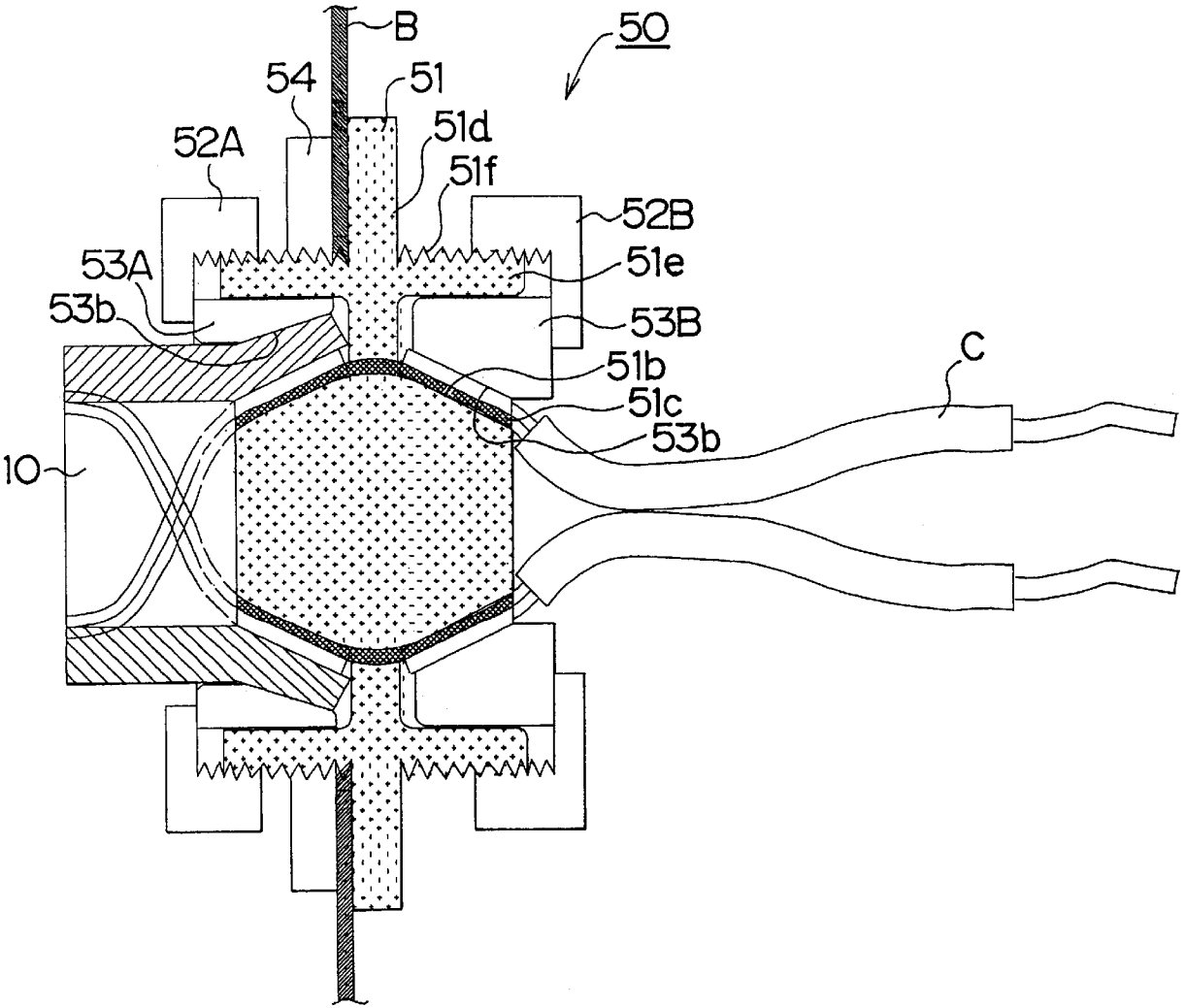
FIG. 19 presents a sectional view representing the third embodiment of the connecting device for tubular switches of the present invention.

FIG. 19 is a sectional view representing the third embodiment of the connecting device for tubular switches of the present invention.

Like the connecting device of the second embodiment, the connecting device 50 of the third embodiment is a device for connecting the tubular switch 10 and cables C, and consists of a main body 51, clamping members 52, spacers 53, a fixing nut 54 and so on.

The main body 51 has a tapered part 51*c* on external surface of a center ball part, which is tapered from the center of the ball, and electrodes 51*c* are formed on the external surface of the tapered part 51*b* so as to follow the conductive members 12 of the tubular switch 10. Further, a ring part 51*d* is formed on the external surface of the center ball part, and flange parts 51*e* are formed on the both sides of the ring part. Male screw parts 51*f* are formed on the external surface of the flange parts 51*e*.

The clamping members 52 have female screw parts 52*a*4 to be screw engaged with the male screw parts 51*f* of the main body 51 on their internal surfaces, and flange parts 52*b* for pressing spacers 53A and 53B, which will be explained below.

The spacers 53A and 53B are provided on the both sides of the main body 51, and their internal surfaces are tapered parts 53*b* corresponding to the tapered parts 51*b* of the main body 51.

The fixing nut 54 is a member for fixing the ring part 51*d* of the main body 51 to a plate B of a case or the like.

(Embodiment of Sealing Device)

Figure 20:
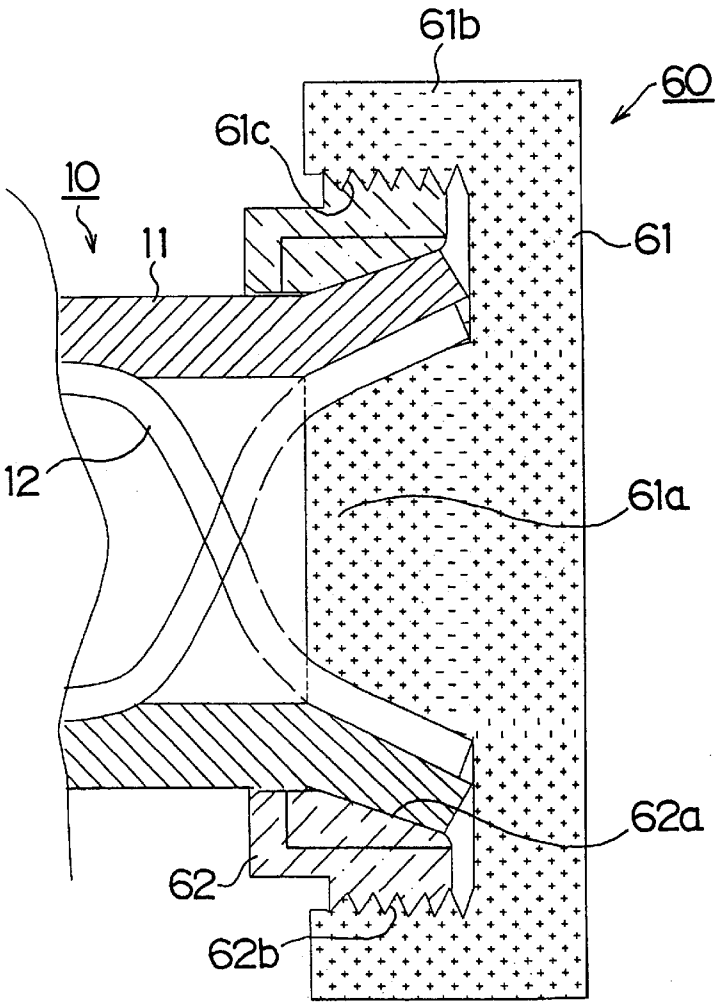
FIG. 20 presents a sectional view representing the sealing device for tubular switches of the present invention.

FIG. 20 is a sectional view representing the first embodiment of the sealing device for tubular switches of the present invention.

This sealing device 60 is an end device connected to an end of the tubular switch 10, and consists of the main body 61, a clamping member 62, and so on.

The main body 61 has a projection part 61*a* formed at center of one face of the main body and having a tapered external surface, a flange part 61*b* provided at periphery of the main body 61, and a female screw part 61*c* formed on the internal surface of the flange part 61*b*, and it is made of an electrically insulating material.

The clamping member 62 has a tapered part 62*a* as its internal surface, and a male screw part 62*b* to be screw engaged with the female screw part 61*c* of the main body 61 as the external surface. It keeps the inside of the tubular switch 10 airtight, and prevents contact between the conductive members 12.

(Fourth Embodiment of Connecting Device)

Figure 21:
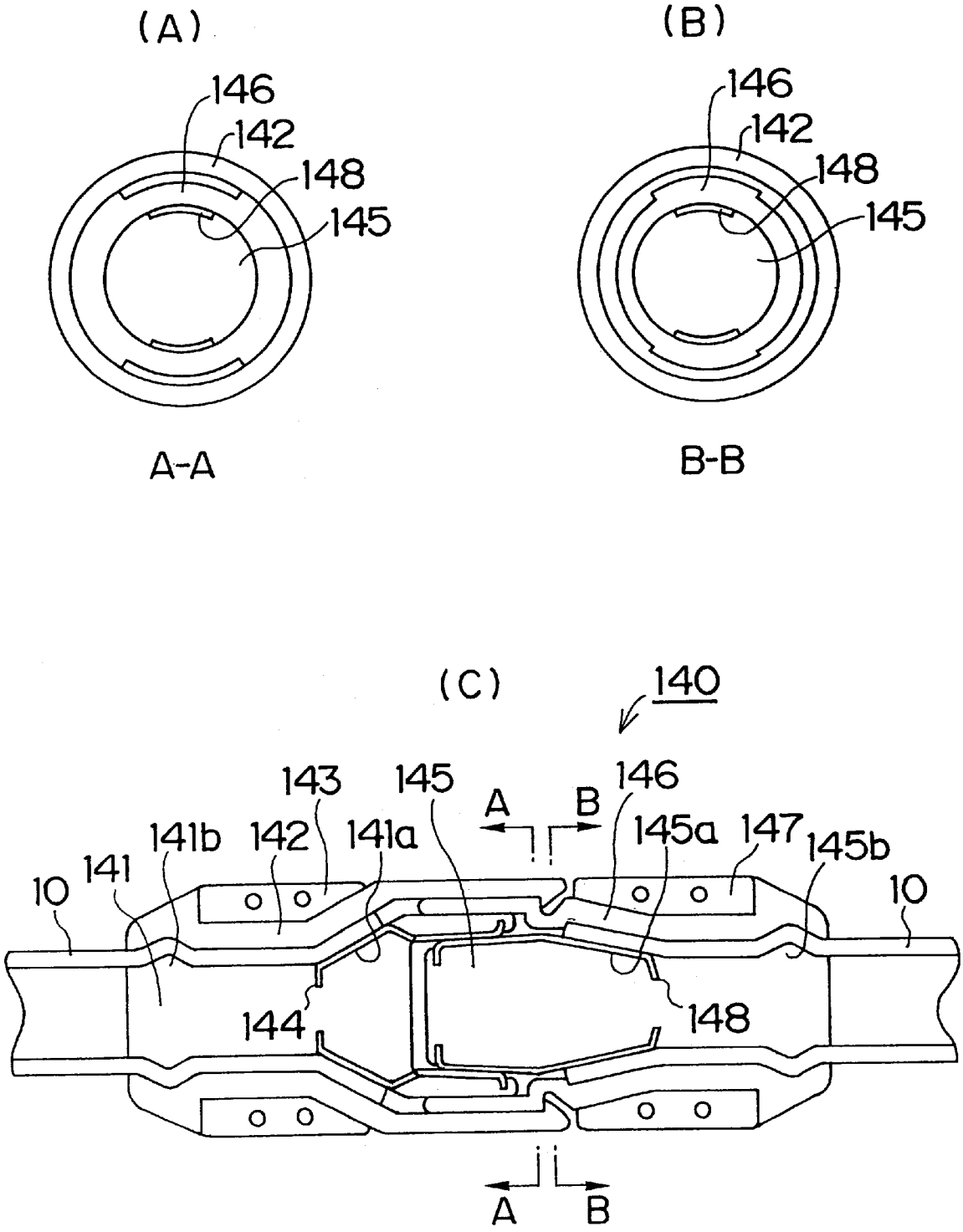
FIGS. 21(*a*) and (*c*) presents sectional views representing the fourth embodiment of the connecting device for tubular switches of the present invention.

FIG. 21 presents drawings representing the fourth embodiment of the connecting device for the tubular switches of the present invention.

This connecting device 140 comprises first and second core members 141 and 145, first and second covering members 142 and 146 disposed outside the core members 141 and 145 and capable of pinching an end of the tubular switch 10 and being airtightly fitted to (or screw engaged with) each other, clamping members 143 and 147 of bisectional type disposed on the external surfaces of the first and second covering members 142 and 146 and tightening them toward its radial center, contact members 144 and 148 of which one ends are connected to the tubular switches 10 and 10, and the other ends are electrically connected when they are jointed, and so on.

The core members 141 and 145 have inclined parts 141*a* and 145*a* having a truncated cone shape as portions to be inserted into ends of the hose members 11, which act to constrict the conductive members 12 provided on the internal surfaces of the hose members 11. The inclined parts 141*a* and 145*a* and projection parts 141*b* and 145*b* act to restrain the movement in the axial direction of the clamping members 143 and 147 provided on the external surface and fix the hose members 11.

(Fifth Embodiment of Connecting Device)

Figure 22:
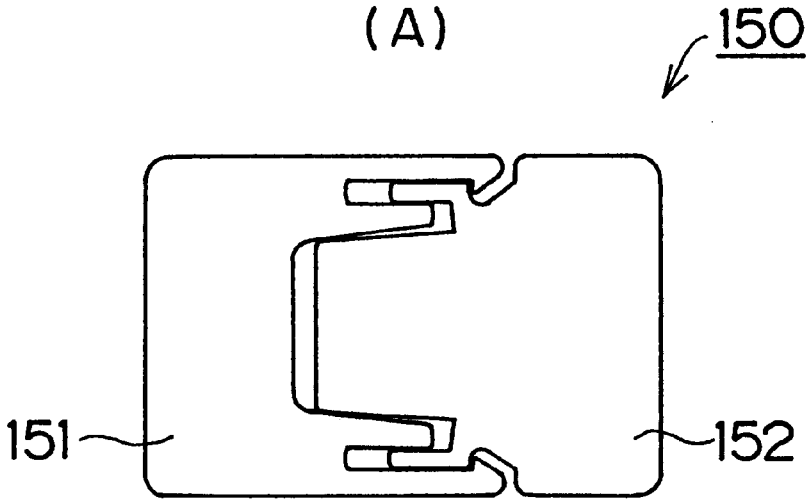
FIGS. 22(*a*) and (*b*) presents sectional views representing the fifth embodiment of the connecting device for tubular switches of the present invention.
Figure 22:
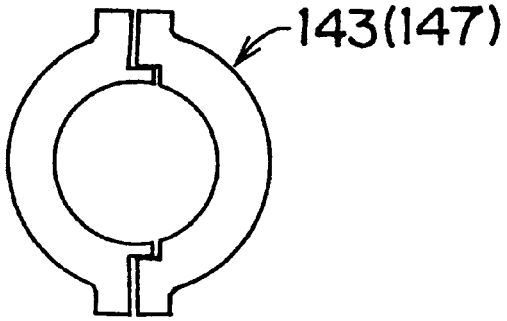

FIG. 22 presents drawings representing the fifth embodiment of the connecting device for the tubular switches of the present invention.

The connecting device 150 of the fifth embodiment comprises sealing members 151 and 152 having the same shapes as the connecting parts of the first and second covering members 142 and 146 of the forth embodiment of the connecting device, and it is connected to an end of the tubular switch 10.

A plug enabling connection to an external electric wire and the like can be provided on these sealing members 151 and 152.

(Ninth Embodiment of Tubular Switch)

Figure 23:
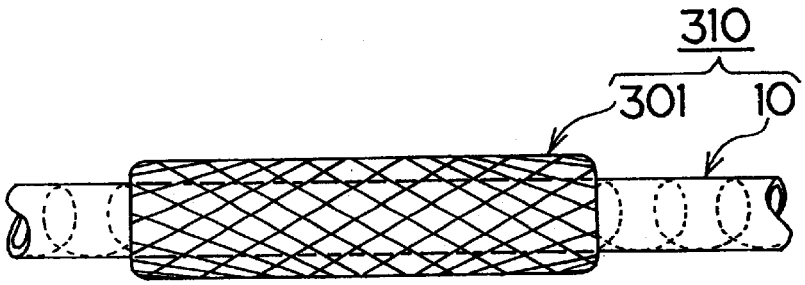
FIG. 23 presents a drawing representing the ninth embodiment of the connecting device for tubular switches of the present invention.

FIG. 23 is a drawing representing the ninth embodiment of the tubular switch of the present invention.

The tubular switch 310 of the ninth embodiment is composed of the tubular switch 10 of the first embodiment further provided with a braid member 301 on the external surface of the tubular switch 10. This braid member 301 is a braid made of woven wires or cords of synthetic fibers or the like, and capable of reinforcing the outer surface of the tubular switch 10.

Because the braid member 301 is provided, tensile strength as well as strength against local external force of the tubular switch 310 according to the ninth embodiment are improved. Because the braid member 301 is a coarse braid, it can transmit ambient pressure (static pressure). Therefore, the tubular switch retains its flexibility, and can be deformed (flattened) by local external pressure. Further, the tubular switch gains weight because of the presence of the braid (especially in case of metal braid). Therefore, buoyancy of the tubular switch in liquids is reduced, and the tubular switch can easily submerged in liquids.

Accordingly, the tubular switch of this embodiment can be utilized in uses where (1) the tubular switch is submerged underwater to sense ambient pressure (bottom), (2) pressure of soil and ballast, mud, snow cover and the like is sensed, (3) deformation (flattening) by local pressure (by stone etc.) is sensed, (4) high pressure is sensed by increasing the internal pressure, and the like.

In these applications, the tubular switch 10 may be expanded and broken by the internal pressure unless the braid member 301 is not present. However, such a situation may be obviated by the braid member 301 provided on the outer surface of the tubular switch.

(First Embodiment of Tubular Switch Sensor)

Figure 24:
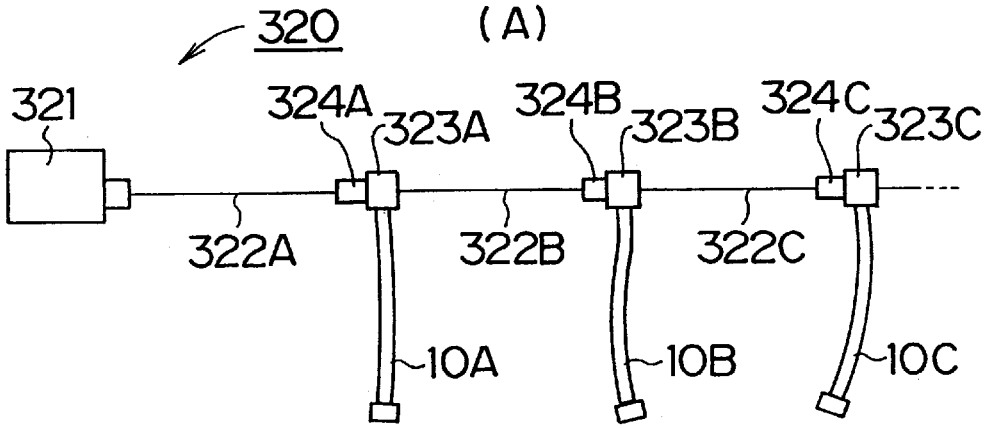
FIGS. 24(*a*) and (*b*) presents drawings representing the first embodiment of the tubular switch sensor of the present invention.
Figure 24:
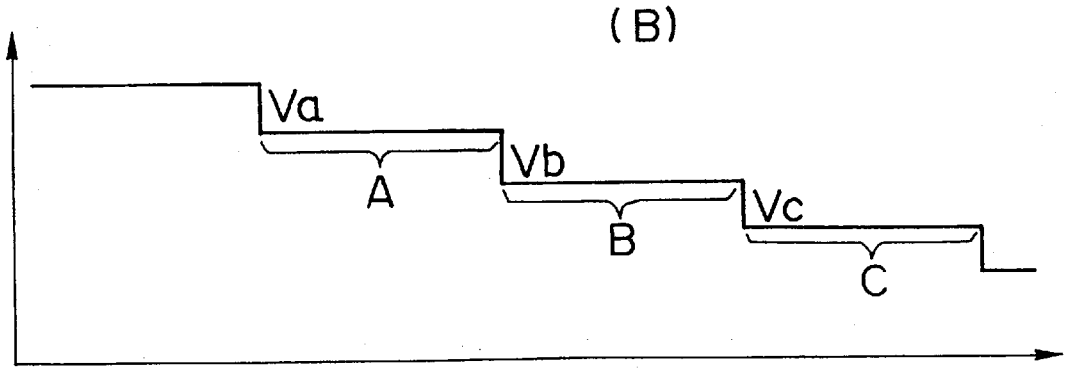

FIG. 24 presents a drawing showing the first embodiment of the tubular switch sensor of the present invention.

In the tubular switch sensor 320, cables in a defined length 322A, 322B, 322C, and so on are connected to a sensor main unit 321 including a voltmeter via connectors 323A, 323B, 323C and so on, and one ends of tubular switches 10A, 10B, 10C and so on are connected to the connectors 323A, 323B, 323C and so on, respectively. Resistances 324A, 324B, 324C and so on are respectively provided in the connectors 323A, 323B, 323C and so on to lower the voltage stepwise.

Accordingly, when any one of the tubular switches 10A, 10B, 10C and so on is turned on, in which section among the sections A, B, C and so on the switch has been turned on can be determined by measuring the voltage V as shown in FIG. 24(B).

(Second Embodiment of Tubular Switch Sensor)

Figure 25:
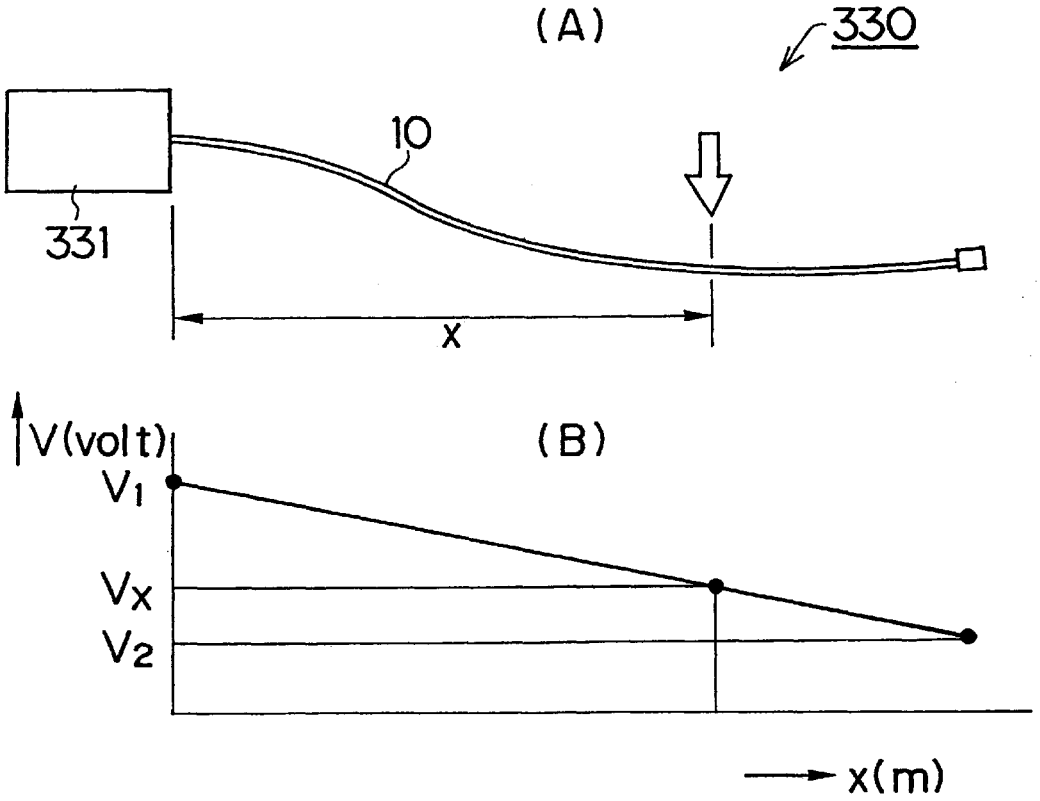
FIGS. 25(*a*) and (*b*) presents drawings representing the second embodiment of the tubular switch sensor of the present invention.

FIG. 25 presents a drawing representing the second embodiment of the tubular switch sensor of the present invention.

This tubular switch sensor 330 consists of a sensor main unit 331 including a voltmeter (or ammeter), to which a tubular switch 10 is connected. In this sensor, a distance x can be detected by measuring voltage Vx (or current).

For example, when the tubular switch 10 is about 30 km in length, where the switch has been turned on (unusual condition occurs) within the distance of 30 km can be detected.

(Third Embodiment of Tubular Switch Sensor)

Figure 26:
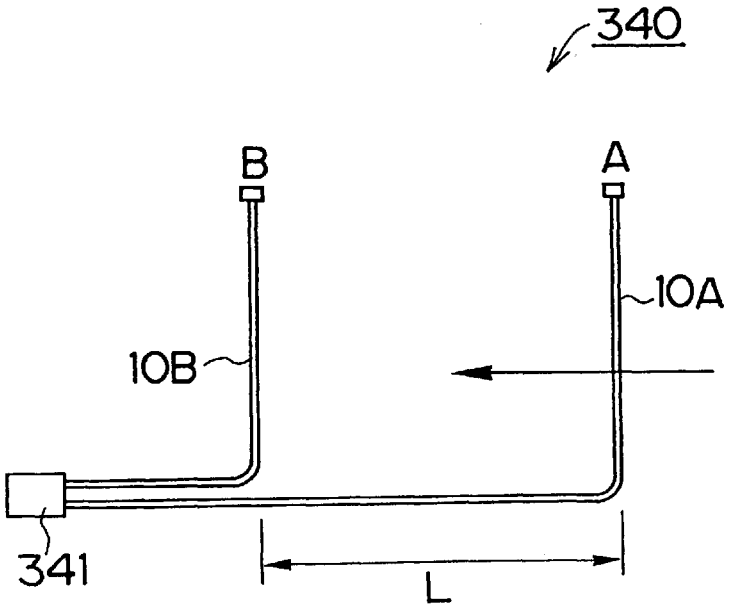
FIGS. 26 presents a drawing representing the third embodiment of the tubular switch sensor of the present invention.

FIG. 26 is a drawing representing the third embodiment of the tubular switch sensor of the present invention.

This tubular switch sensor 340 consists of a sensor main unit 341 including a timer, and tubular switches 10A and 10B disposed so that they are separated by a distance L. Time from when the tubular switch 10A at a point A has been turned on to when the tubular switch 10B at a point B is turned on can be measured to obtain an average velocity of a vehicle and the like passing the interval from A to B.

This tubular switch sensor 340 can be equipped with a video camera, digital camera or the like to simultaneously record image data and the velocity data mentioned above. This operation may be linked with a shutter of camera to obtain time recording, and it can be used as a proof of speeding.

Further, this tubular switch sensor 340 can be used for count of number of passing vehicles by using a shorter distance L, for example, a distance shorter than a wheel base of vehicles (distance between two axles), counting turning on at the point A and point B as one time, and dividing the count by an average axle number of the vehicles to afford the number of passing vehicles (passing axle number/average axle number =number of vehicles).

The sensor can also be used for detection of momentary speed, sensing traffic jam and the like.

(Fourth Embodiment of Tubular Switch Sensor)

Figure 27:
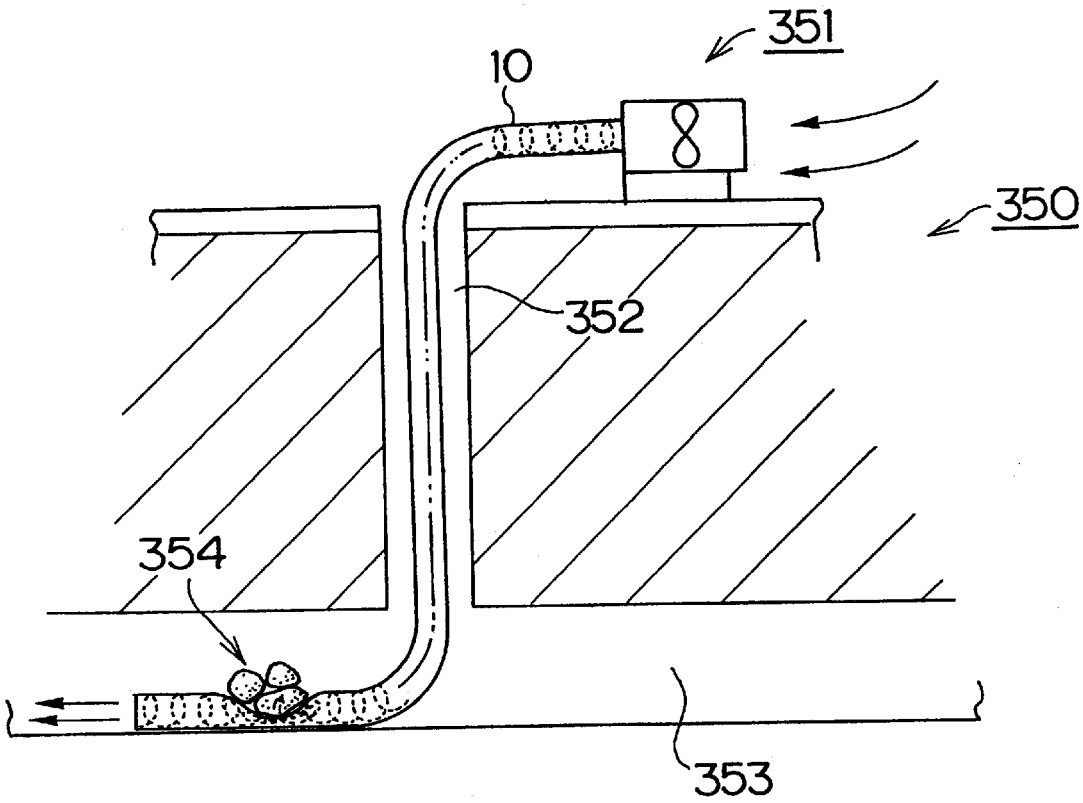
FIG. 27 presents a drawing representing the fourth embodiment of the tubular switch sensor of the present invention.

FIG. 27 is a drawing representing the fourth embodiment of the tubular switch sensor of the present invention.

This tubular switch sensor 350 uses a tubular switch 10 as an aeration hose for aeration of building site of subways, mines, large-sized tanks and the like, and it is intended for sensing abnormal condition of the aeration due to deformation of the aeration hose.

The tubular switch sensor 350 comprises a main sensor unit 351 including a blower, detection circuit, alarm and the like, and a tubular switch 10 connected to the main sensor unit 351. The sensor sends air to a building site 353 through the tubular switch 10 (ventilation hose) disposed through a manhole 352. When a tubular switch 10 is deformed by falling rock 354 or the like, it can be detected and an alert can be put out.

The tubular switch 10 can be used as an aeration hose and a switch for detecting abnormality where the aeration hose is deformed, and concurrently used as a conducting cable during usual time.

(Fifth Embodiment of Tubular Switch Sensor)

Figure 28:
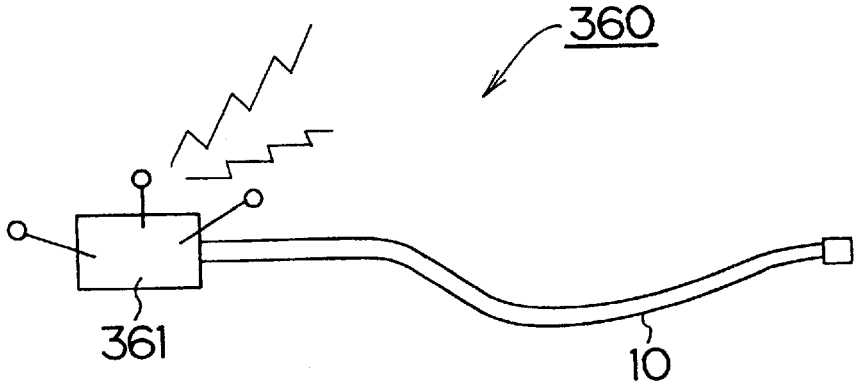
FIG. 28 presents a drawing representing the fifth embodiment of the tubular switch sensor of the present invention.
Figure 29:
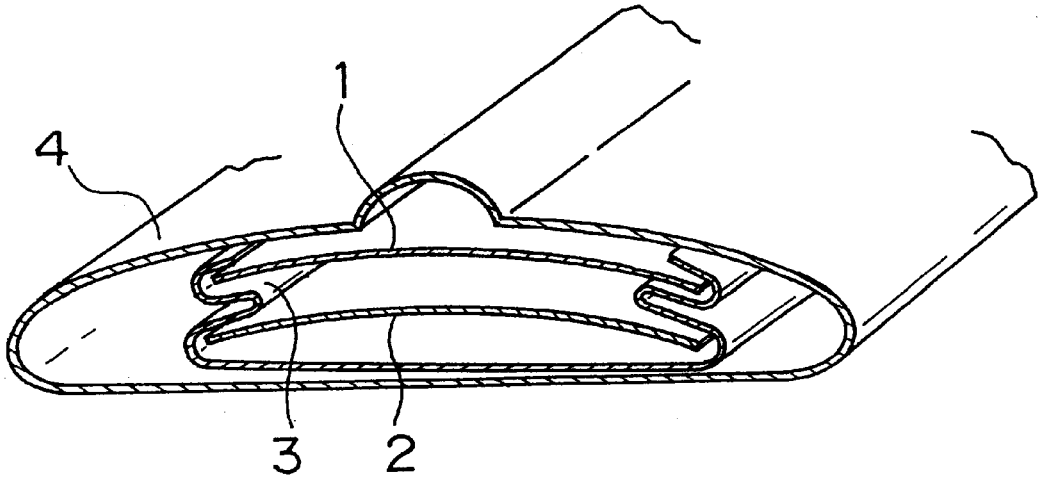
FIGS. 29(*a*) and (*b*) presents drawings representing an example of conventional long length switches (tape switch).
Figure 29:
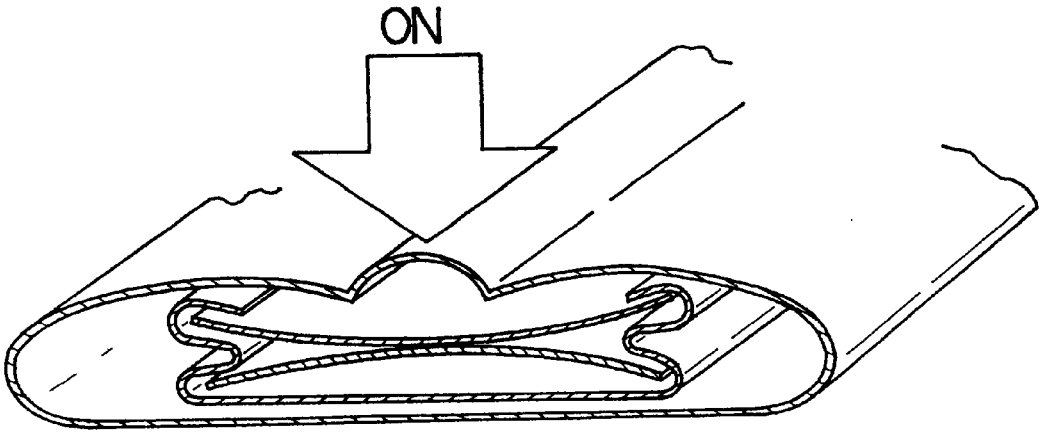

FIG. 28 is a drawing representing the fifth embodiment of the tubular switch sensor of the present invention.

This tubular switch sensor 360 comprises a sensor main unit 361 including a detection circuit, battery, antenna and radio transmitter, and a tubular switch 10 connected to the sensor main unit 361, and can be used as a sensor for sensing landslides and the like.

The antenna is preferably of non-directional type, and may have a structure such as tumbler structure, floater structure, and spherical structure. If it is one capable of automatically tracking an artificial communication satellite, the sensor may be used anywhere.

When the switch is once turned on and the on-state is continued, the detection circuit can sense it as occurrence of landslide or the like. If the system is designed so that the switch is turned off after a certain period of time (reset by a timer), the detection circuit can sense temporary pressure.

Because this tubular switch sensor 360 is small in size and does not require wiring, it can be installed anywhere by itself. The sensor main unit 361 can easily designed to distinguish which sensor is turned on by changing transmitting frequency of the radio transmitter. A receiving center may be remote from the sensor and may be in transit, and hence the system can be used for anti-disaster vehicles.

This switch sensor 360 can easily be installed in a large number, and for example, it may be installed by dropping it from a flying helicopter.

Other than landslide, the sensor can be used for sensing snowslide, invasion of humans and animals, pressure received when an object strikes (i.e., used as limit switch) and the like. For these applications, sensitivity may be adjusted by changing the pressure in the hose member.

As explained hereinabove, various advantages can be obtained according to the present invention such as mentioned below.

(1) The tubular switch of the present invention does not show directionality because the conductive members are covered with the hose member, and it can be easily wound up because of its flexibility, (2) Switch operation pressure can be adjusted by changing the internal pressure of the hose member, (3) Its continuous molding is possible because of its simple structure comprising only the hose member and the conductive members, and hence long length ones can be produced at low cost.

(4) Break down points can be easily discovered from the outside by using a transparent or translucent hose member. When it is damaged, the damaged portion can be cut and removed, and the remained portions can easily be connected with a connecting device to regenerate the tubular switch. Its visibility can be enhanced by providing a luminescent member or light reflecting member in its inside.

What is claimed is:

1. A tubular switch having first and second ends, comprising:

a tubular hose member which is insulating and elastic, which is one of transparent or translucent, which has a length, an internal surface, and an external surface, and within which is defined an internal space; and a plurality of flexible conductive members which are spirally positioned adjacent to and fixedly connected to the internal surface of the tubular hose member, and which have respective surfaces which are partially exposed to the internal space of the tubular hose member along the entire length thereof.

2. The tubular switch according to claim 1, wherein the plurality of flexible conductive members have elasticity, are one of transparent or translucent, and have a shape which is one of tubular or cord-shaped.

3. The tubular switch according to claim 1, wherein the tubular hose member has one of a luminescent member or a light-reflecting member provided on one of the internal surface thereof or the external surface thereof.

4. A connecting device in combination with at least one tubular switch according to claim 1, the connecting device comprising a core member which has an external surface, and which is inserted into the tubular hose member so that the core member closely contacts the internal surface of the tubular hose member;

a plurality of contact point members which are provided on at least a portion of the external surface of the core member and which contact at least one of the plurality of flexible conductive members; and a covering member positioned on the external surface of the tubular hose member, wherein the connecting device is positioned to one of (a) connect the first end of one tubular switch to the second end of another tubular switch, (b) connect the first end of one tubular switch to an external electric wire, or (c) engage and seal one of the first end or the second end of one tubular switch.

5. The connecting device of claim 4, wherein first and second connecting devices are provided, the first connecting device being connected to the first end of one tubular switch, and the second connecting device being one of (a) connected to the second end of another tubular switch, (b) connected to an external electric wire, or (c) sealingly engaged to the second end of said one tubular switch, and wherein the covering member of the first connecting device and the covering member of the second connecting device are engaged and fixedly connected to one another by one of being fitted or screwed.

6. A tubular switch, comprising:

a tubular hose member which is insulating and elastic, which has a length, an internal surface and an external surface, and within which is defined an internal space; and a plurality of flexible conductive members which are spirally positioned adjacent to and fixedly connected to the internal surface of the tubular hose member, and which have respective surfaces which are partially exposed to the internal space of the tubular hose member along the entire length thereof, wherein the plurality of flexible conductive members are bare electric wire members composed of a plurality of woven fine metal strands.

7. The tubular switch according to claim 6, wherein the plurality of flexible conductive members have elasticity, are one of transparent or translucent, and have a shape which is one of tubular or cord-shaped.

8. The tubular switch according to claim 6, wherein the tubular hose member has one of a luminescent member or a light-reflecting member provided on one of the internal surface thereof or the external surface thereof.

9. A tubular switch, comprising:

a tubular hose member which is insulating and elastic, which has a length, which is one of transparent or translucent, which has an internal surface and an external surface, and within which is defined an internal space; and a plurality of flexible conductive members which are spirally positioned adjacent to and fixedly connected to the internal surface of the tubular hose member, and which have respective surfaces which are partially exposed to the internal space of the tubular hose member along the entire length thereof, wherein the plurality of flexible conductive members are comprised of a conductive layer having flexibility and elasticity, and an insulation layer having flexibility and elasticity, which are alternately wound in a spiral, and a bare electric wire member wound on the external surface of the conductive layer, and wherein the tubular hose member is comprised of an insulating material and covers the conductive layer, the insulation layer, and the bare electric wire member.

10. The tubular switch according to claim 9, wherein the plurality of flexible conductive members have elasticity, are one of transparent or translucent, and have a shape which is one of tubular or cord-shaped.

11. The tubular switch according to claim 9, wherein the tubular hose member has one of a luminescent member or a light-reflecting member provided on one of the internal surface thereof or the external surface thereof.

12. A tubular switch, comprising:

a tubular hose member which is insulating and elastic, which has a length, an internal surface, and an external surface, and within which is defined an internal space; and a plurality of flexible conductive members which are spirally positioned adjacent to and fixedly connected to the internal surface of the tubular hose member, and which have respective surfaces which are partially exposed to the internal space of the tubular hose member along the entire length thereof, wherein each flexible conductive member of the plurality of flexible conductive members comprises a bare electric wire member and a joint member, the bare electric wire member comprising a tubular mesh member comprised of metal wires woven in a tubular shape, and the joint member joining the bare electric wire member to the tubular hose member, having internal and external surfaces, being composed of a material having flexibility, elasticity, and adherence to the tubular hose member, and being inserted into the tubular mesh member.

13. The tubular switch according to claim 12, wherein one of the joint member or the plurality of flexible conductive members have elasticity, are one of transparent or translucent, and have a shape which is one of tubular or cord-shaped.

14. The tubular switch according to claim 12, wherein one of the joint member or the tubular hose member has one of a luminescent member or a light-reflecting member provided on one of the internal surface thereof or the external surface thereof.

15. A tubular switch, comprising:

a tubular hose member which is comprised of a material which is insulating and elastic, which has a length, an internal surface, and an external surface, and within which is defined an internal space; and a plurality of flexible conductive members which are spirally positioned adjacent to and fixedly connected to the internal surface of the tubular hose member, and which have respective surfaces which are partially exposed to the internal space of the tubular hose member along the entire length thereof wherein each of the plurality of conductive members comprises a bare electric wire member and a joint member, the joining member jointing the bare electric wire member to the tubular hose member, the bare electric wire member being a metal wire selected from the group consisting of monofilaments, twisted wires and flat mesh wires, and the joint member having internal and external surfaces, being composed of a material having flexibility, elasticity, and adherence to the tubular hose member, which material is comprised of one of a conductive rubber or conductive resin, and being twisted with the metal wire.

16. The tubular switch according to claim 15, wherein one of the joint member or the plurality of flexible conductive members have elasticity, are one of transparent or translucent, and have a shape which is one of tubular or cord-shaped.

17. The tubular switch according to claim 16, wherein one of the joint member or the tubular hose member has one of a luminescent member or a light-reflecting member provided on one of the internal surface thereof or the external surface thereof.

18. The tubular switch according to claim 15, wherein one of the joint member or the tubular hose member has one of a luminescent member or a light-reflecting member provided on one of the internal surface thereof or the external surface thereof.

19. A tubular switch, comprising:

a tubular hose member which is comprised of a material which is insulating and elastic, which has a length, an internal surface, and an external surface, and within which is defined an internal space;

a plurality of flexible conductive members which are spirally positioned adjacent to and fixedly connected to the internal surface of the tubular hose member, and which have respective surfaces which are partially exposed to the internal space of the tubular hose member along the entire length thereof; and a reinforcing member which is comprised of woven metal wires or synthetic fibers and which is provided on the external surface of the tubular hose member.

* * * * *